US007732703B2

(12) United States Patent
Lazovic

(10) Patent No.: US 7,732,703 B2
(45) Date of Patent: Jun. 8, 2010

(54) MUSIC PROCESSING SYSTEM INCLUDING DEVICE FOR CONVERTING GUITAR SOUNDS TO MIDI COMMANDS

(75) Inventor: Darko Lazovic, Belgrade (RS)

(73) Assignee: Ediface Digital, LLC., Deer Park, IL (US)

( * ) Notice: Subject to any disclaimer, the term of this patent is extended or adjusted under 35 U.S.C. 154(b) by 269 days.

(21) Appl. No.: 12/025,202

(22) Filed: Feb. 4, 2008

(65) Prior Publication Data

US 2009/0100991 A1 Apr. 23, 2009

Related U.S. Application Data

(63) Continuation-in-part of application No. 11/873,970, filed on Oct. 17, 2007.

(60) Provisional application No. 61/019,039, filed on Jan. 4, 2008.

(30) Foreign Application Priority Data

Feb. 5, 2007 (RS) ..... 2007/0015

(51) Int. Cl.
*G10H 7/00* (2006.01)

(52) U.S. Cl. ..... 84/645

(58) Field of Classification Search ..... 84/645
See application file for complete search history.

(56) References Cited

U.S. PATENT DOCUMENTS 3,571,522 A 3/1971 Cox
4,217,808 A 8/1980 Slepian et al.
4,523,506 A 6/1985 Hollimon
4,627,323 A 12/1986 Gold
4,688,464 A 8/1987 Gibson et al.
4,829,872 A 5/1989 Topic et al.
5,018,427 A 5/1991 Uchiyama
5,033,353 A * 7/1991 Fala et al. ..... 84/72
5,048,391 A 9/1991 Uchiyama et al.
5,083,491 A 1/1992 Fields
5,218,160 A * 6/1993 Grob-Da Veiga ..... 84/735
5,262,714 A 11/1993 Friedman
5,293,879 A 3/1994 Vonk et al.

(Continued)

FOREIGN PATENT DOCUMENTS

JP 2002215145 7/2002

(Continued)

OTHER PUBLICATIONS

O'Malley, Ronan; "Advanced MIDI Guitar Effects System"; Department of Electronic Engineering; pp. 4; National University of Ireland.

(Continued)

*Primary Examiner*—Jeffrey Donels

(57) ABSTRACT

A device is disclosed for converting guitar sounds to MIDI commands. The device has 7 microcontrollers. Each guitar string's oscillations are filtered and amplified with input filters and input amplifiers. The conditioned string signal is directed to an input of an associated microcontroller and converted to a MIDI command. Each string has an input filter and amplifier, and a microcontroller that converts the string oscillations into a MIDI command. MIDI commands from all six microcontrollers are received and processed by a main microcontroller that transmits the commands to the MIDI interface of a musical instrument with additional modification, if needed.

3 Claims, 29 Drawing Sheets

U.S. PATENT DOCUMENTS

| | | | | |
|---|---|---|---|---|
| 5,430,243 | A | 7/1995 | Shioda | |
| 5,504,270 | A | 4/1996 | Sethares | |
| 5,591,931 | A * | 1/1997 | Dame | 84/726 |
| 5,619,004 | A | 4/1997 | Dame | |
| 5,780,759 | A | 7/1998 | Szalay | |
| 5,808,225 | A | 9/1998 | Corwin et al. | |
| 5,942,709 | A | 8/1999 | Szalay et al. | |
| 5,986,201 | A * | 11/1999 | Starr et al. | 84/645 |
| 6,111,186 | A * | 8/2000 | Krozack et al. | 84/736 |
| 6,166,566 | A | 12/2000 | Strong | |
| 6,191,350 | B1 * | 2/2001 | Okulov et al. | 84/646 |
| 6,525,255 | B1 | 2/2003 | Funaki | |
| 6,846,980 | B2 * | 1/2005 | Okulov | 84/646 |
| 7,038,123 | B2 | 5/2006 | Ludwig | |
| 7,102,072 | B2 | 9/2006 | Kitayama | |
| 7,399,918 | B2 * | 7/2008 | Juszkiewicz et al. | 84/742 |
| 7,563,977 | B2 * | 7/2009 | Cummings | 84/735 |
| 7,601,908 | B2 * | 10/2009 | Ambrosino | 84/742 |
| 2003/0061931 | A1 | 4/2003 | Ishii et al. | |
| 2006/0011052 | A1 | 1/2006 | Purchon et al. | |
| 2006/0107826 | A1 * | 5/2006 | Knapp et al. | 84/724 |
| 2007/0017345 | A1 | 1/2007 | Stoneback | |
| 2007/0137466 | A1 | 6/2007 | Lindemann | |
| 2007/0227344 | A1 * | 10/2007 | Ryle et al. | 84/723 |
| 2007/0256551 | A1 * | 11/2007 | Knapp et al. | 84/722 |
| 2008/0282873 | A1 * | 11/2008 | Kotton et al. | 84/645 |

FOREIGN PATENT DOCUMENTS

| | | |
|---|---|---|
| SU | 1167642 | 7/1985 |

OTHER PUBLICATIONS

Karjalainen et al.; Acoustic Sound from the Electric Guitar Using DSP Techniques; Journal; 2000; pp. 773-776; IEEE.

Baalman, Marije A. J.; "The STRIMIDILATOR: a String Controlled MIDI-Instrument"; Proceedings of the 2003 Conference on New Interfaces for Musical Expression; pp. NIME 03-19 to NIME 03-23; Montreal, Canada.

International Search Report and Written Opinion from corresponding PCT/US07/81662.

International Search Report from corresponding PCT/US08/52940.

* cited by examiner

MUSIC PROCESSING SYSTEM INCLUDING DEVICE FOR CONVERTING GUITAR SOUNDS TO MIDI COMMANDS

RELATED APPLICATION DATA

This application is a continuation in part of U.S. application Ser. No. 11/873,970, filed Oct. 16, 2007, currently pending, and claims priority to Serbian Patent application Ser. No. 2007-0015, filed Feb. 5, 2007, and the benefit of provisional application Ser. No. 61/019,039 filed Jan. 4, 2008, the disclosures all of which are incorporated by reference herein.

BACKGROUND

This disclosure generally pertains to a music processing system that converts sound from musical instruments into an electronic data format. More specifically, this invention pertains to a system and method that converts sound generated by musical instruments to a form to be used in electronic media based on a first harmonic of an input signal. In one embodiment, the data format is the Musical Instrument Digital Interface (MIDI) format.

For years digital keyboard players enjoyed unparalleled flexibility and functionality in interfacing and composing with their computers, such as the ability to instantly create notation and change sounds generated by their instruments with the push of a button. The music processing system described herein offer this flexibility and functionality to guitarists as well as the ability to use a guitar with computer games. The methods and apparatus described may comprise a pick-up and converter that attaches directly to any electric, acoustic electric or acoustic guitar, thereby making a user's guitar fully plug and play compatible with Windows XP or higher as well as Mac OSX. Preferably, no driver installation is necessary.

The music processing system described herein may be adapted for use with Guitar Wizard, a game that allows users to jam along to popular songs while learning to play a real guitar. Guitar Wizard teaches aspiring musicians everything from single note picking to complex chords and strumming techniques. Modern Digital Audio Workstation (DAW) software, such as Sony Acid™ Music Studio and Apple GarageBand harness the power of PCs, allowing musicians to play samples and software instruments. With the music processing system described herein, guitarists can control these programs to play sampled sounds and synthesized instruments such as a keyboard or piano, a different style guitar, drums or a woodwind instrument. Using the music processing system described herein, guitarists can compose a complete masterpiece controlling and recording each instrument from trumpets to tympanis using their guitar.

Using the music processing system described herein, users will enjoy the ability to connect a real guitar to console systems bridging the gap between gaming and reality. For instance, using the music processing system described herein, one may be able to: use a guitar to connect with a computer, operating with for instance Windows XP and/or Mac OSX; learn to play guitar; record, compose and edit music easily; arrange with flexibility and control; and convert recorded songs into sheet music. As described below, the pick-up and control components of the music processing system mount on any guitar and preferably recognizes and transmits specific instructions for each individual note played on the guitar, thereby allowing for great flexibility in playing and recording. This is conveyed simply as a list of events which describe the specific steps that a soundcard, program or other device use to generate the specific sound. At its simplest the language would indicate for example 'Middle C on" at a specific time along with the volume of the note—then it would indicate "Middle C off" at a later time. Any number of other commands can be added to make it as expressive as desired.

Thus, the music processing system may allow the user to make his or her guitar sound like another instrument. With the system, a guitar can sound like anything: a keyboard or piano, a completely different style guitar or a guitar with any number of different effects applied, a woodwind or brass instrument or the human voice. Each note can even be assigned to play a different recorded clip or sound effect. Different or "drop" tunings are simple because the note or tuning of the guitar need not be changed. The instructions for playing the note are simply "transposed" to the desired note in accordance with the desired tuning. The language of the music processing system is very specific as to what note is being played down to the specific fret on each string. This information can be used in conjunction with a learning program to teach guitar. Since each string is tracked individually this can be a very complex and robust application, teaching everything from single note picking to complex chords and strumming techniques.

Furthermore, the instructions generated can optionally be recorded on a computer memory. This allows recorded instructions to be edited using computer software. A single note within a recorded song is easily adjusted because all that is changed is the instruction for that specific note. To change or delete a note or passage in a regular recording would require clipping out the undesirable portion and re-recording—not an easy task as precision is next to impossible yet required. An embodiment described herein also allows for easy tempo changes of a recorded performance. The instruction is simply adjusted to change the tempo, thereby avoiding pitch change when a recording slowed down. Editing recorded music is simple using computer software—drag and drop functionality may be provided to edit individual notes. Shorten or lengthen a note simple by clicking on it and changing its duration. Using software, the user can change the whole recording to a new key using the same principle described above regarding alternate tunings. Users can cut and paste a section for use later in the song. File size is small because the methods described herein store instructions for playing a note, not sampling and digitizing the actual note or sound wave. This saves storage space on a hard drive. For example a sampled or digitized 1 minute clip requires about 10 Megabytes of data. The same 10 seconds with the music processing system only requires 10 Kilobytes for the same 1 minute clip. Many files that are already recorded in this language have tracks that are separated from the rest of the tracks making it easy to listen to just one instrument track and study it to learn more about it or how to play it. Then this track can be muted, played over to practice playing the song or for a live performance with backing tracks. One may print out actual sheet music of what has been recorded. It is very simple to convert the recorded instructions into musical notation. One may also create a ring tone for a cell phone.

The music processing system can be used to trigger much more than notes. The instructions for turning a note on and off and other such commands can optionally be used to activate any action or event within a program or computer game. Many prerecorded elements such as loops or tracks can be triggered on a computer program turning them on and off as backing tracks for example. These elements can also be turned on and off building them to create a song by selecting each individual element by playing a single note. Events can optionally be triggered in games. Playing a specific note or notes can be used for a game such as Guitar Hero™ or other similar game. It can be as simple as the current offerings or as complex as a real-world guitar performance. Notes could even be used to move a character around the screen. Embodiments of the present invention can also be used in conjunction with a wide variety of musical equipment. Most electronic musical equipment supports one of the various versions of the MIDI format.

One using the technology disclosed herein can achieve sound electronically using any classical instruments or any sound source. One method disclosed herein includes analyzing sound from the sound source, and then generating an appropriate sound electronically based on the detection of the first harmonic of the input signal. The second method disclosed herein requires fast and precise first harmonic period determination from the signals generated by a classical instrument, and then the measured period may be transformed to digital information acceptable by electronic instruments to generate sound electronically. Algorithms for transforming the measured period into digital information are disclosed in a co-pending patent application entitled "Adaptive Triggers Method for Signal Period Measuring," U.S. application Ser. No. 11/873,970, filed Oct. 17, 2007, the disclosure of which is incorporated by reference herein. However, other tone detection methods known in the art may also be used. Such algorithms, which for instance provide a solution for transforming guitar sounds to MIDI commands, require powerful thirty-two bit microprocessors and/or DSP processors, as will be described below.

SUMMARY OF THE INVENTION

One embodiment relates to a controller for a guitar. In the controller, a plurality of small capacity microcontrollers are used. For functions related to analyzing sounds generated by a guitar string, detecting basic harmonics, and generating MIDI information, one small capacity microcontroller is used for each guitar string. Electrical signals generated by one guitar string include oscillations that are filtered and amplified by analog filters and analog amplifiers. The filtered and amplified signal is directed to one of the input pins of the small capacity microcontroller. The small capacity microcontroller is programmed to analyze and detect the input sound signal generated by each guitar string, for instance, by using the methods disclosed in U.S. application Ser. No. 11/873,970. The methods also enable the microcontroller to generate an output MIDI command corresponding to the input signal. The MIDI command may be generated when the microcontroller detects the sound signal, or when the input signal is lost during monitoring of the sound signal. When a MIDI command is ready to be transmitted, the small capacity microcontroller signals a main microcontroller and waits for the main microcontroller to signal the small capacity microcontroller to allow the MIDI message to be transmitted to the main microcontroller. The main microcontroller collects MIDI messages from all six small capacity microcontrollers, modifies the received MIDI commands, if needed, and sends a new the MIDI message over the MIDI interface to an electronic instrument with an MIDI interface.

Figure 19:
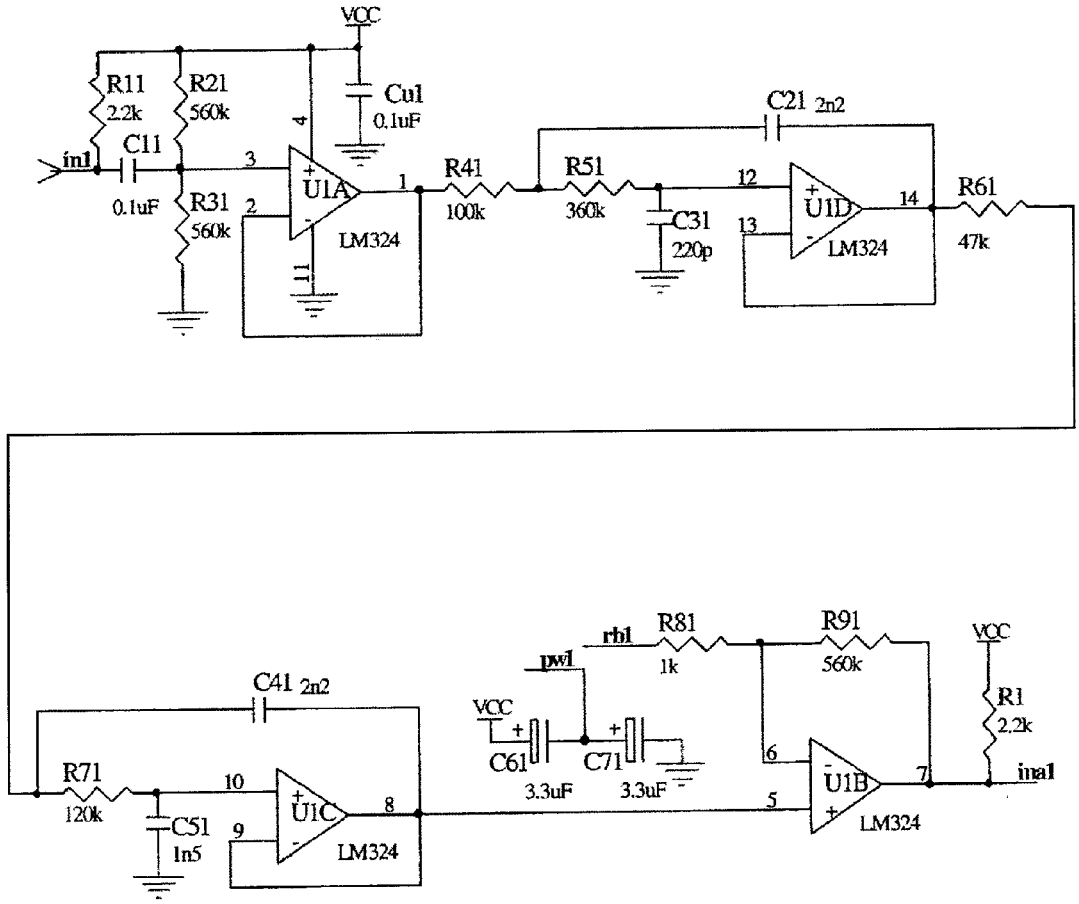
Figure 20:
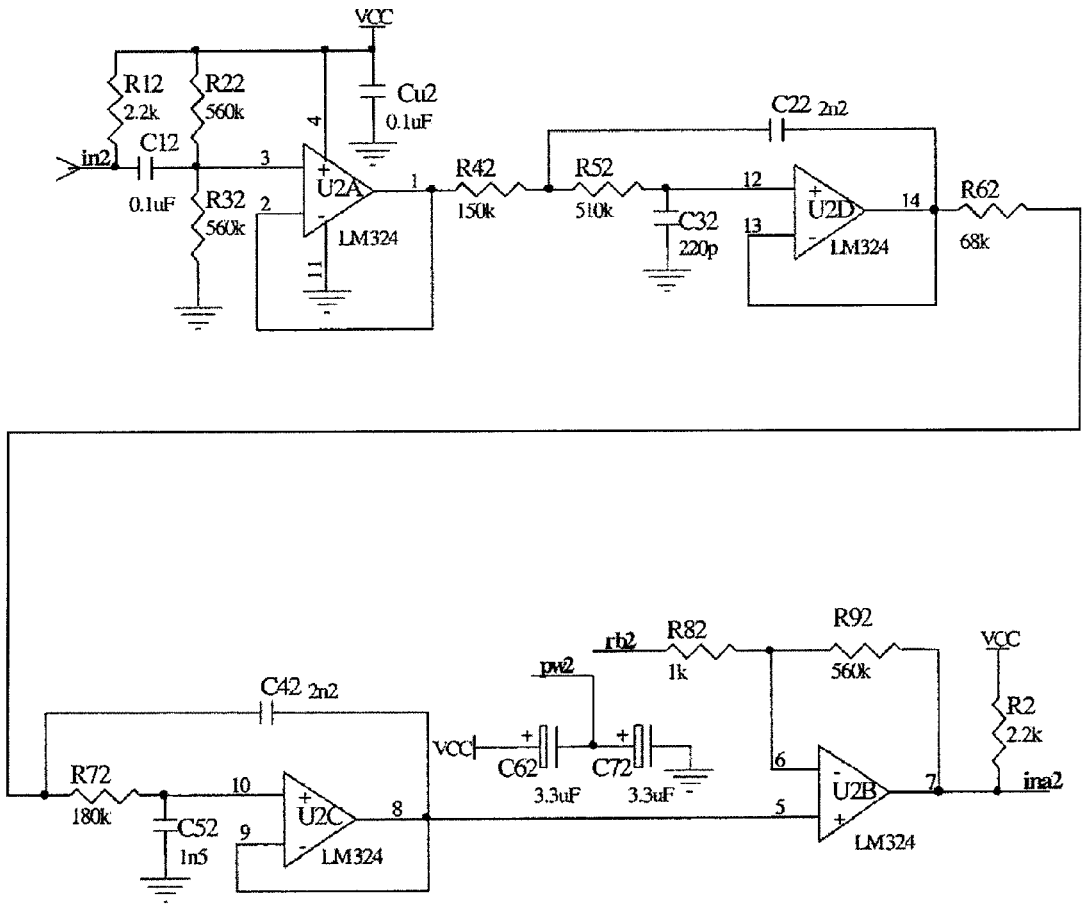
Figure 21:
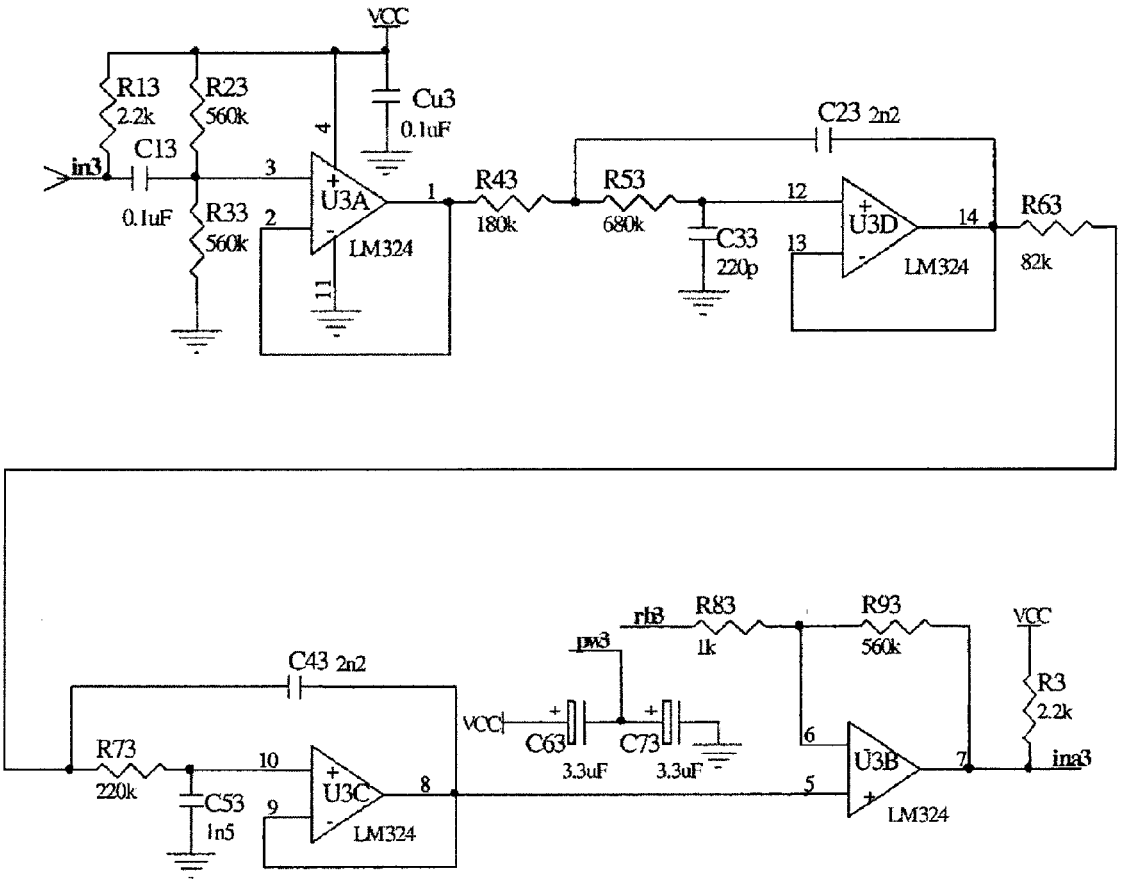
Figure 22:
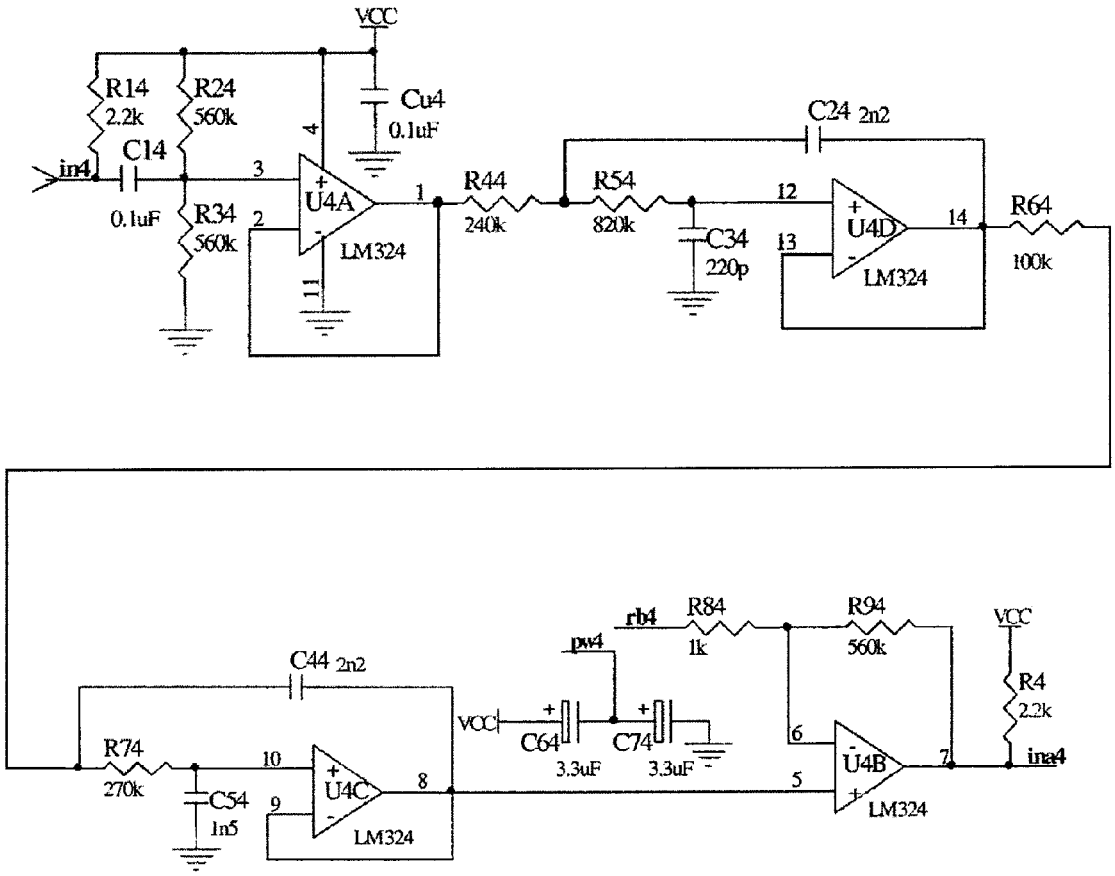
Figure 23:
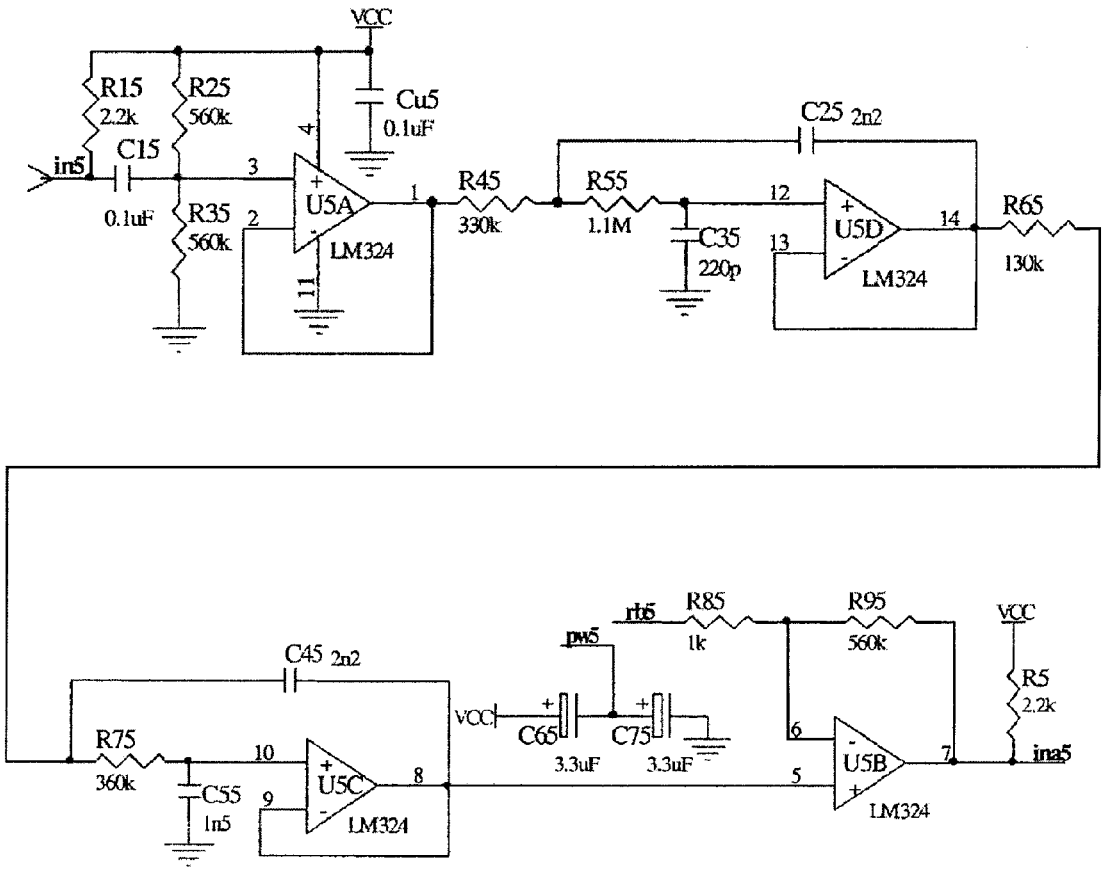
Figure 24:
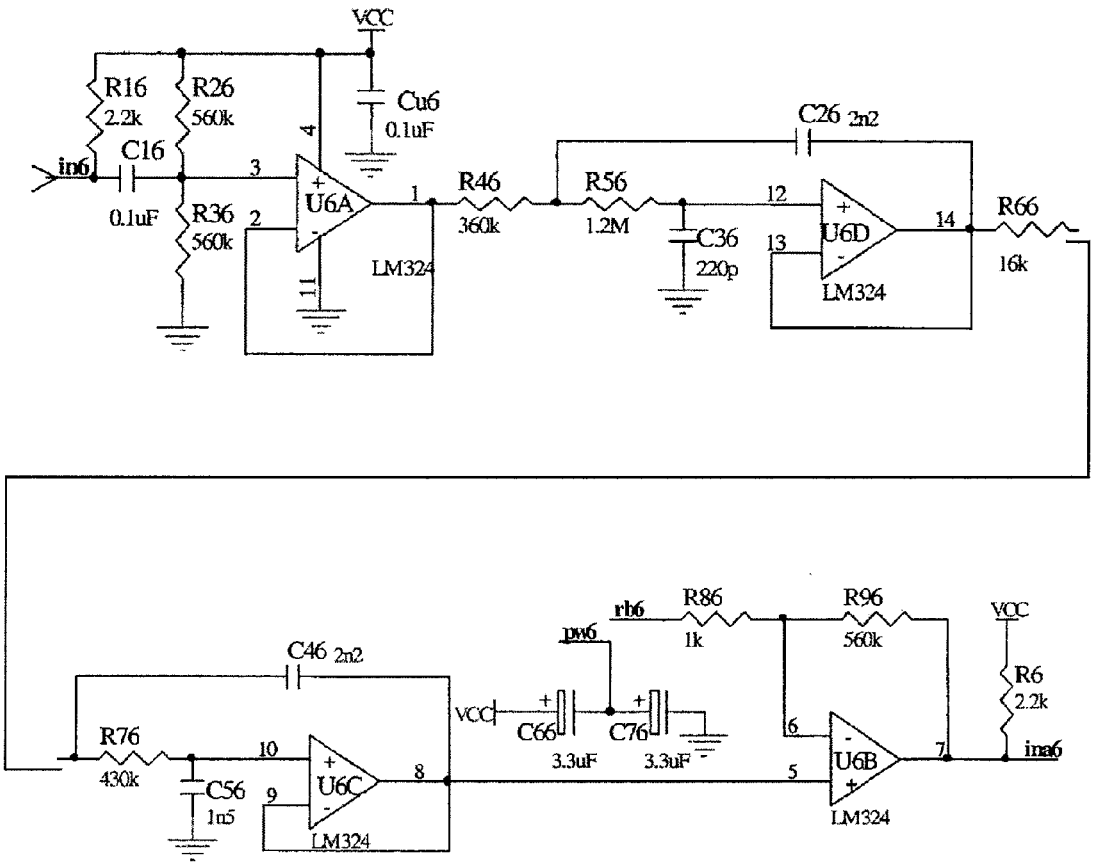
Figure 25:
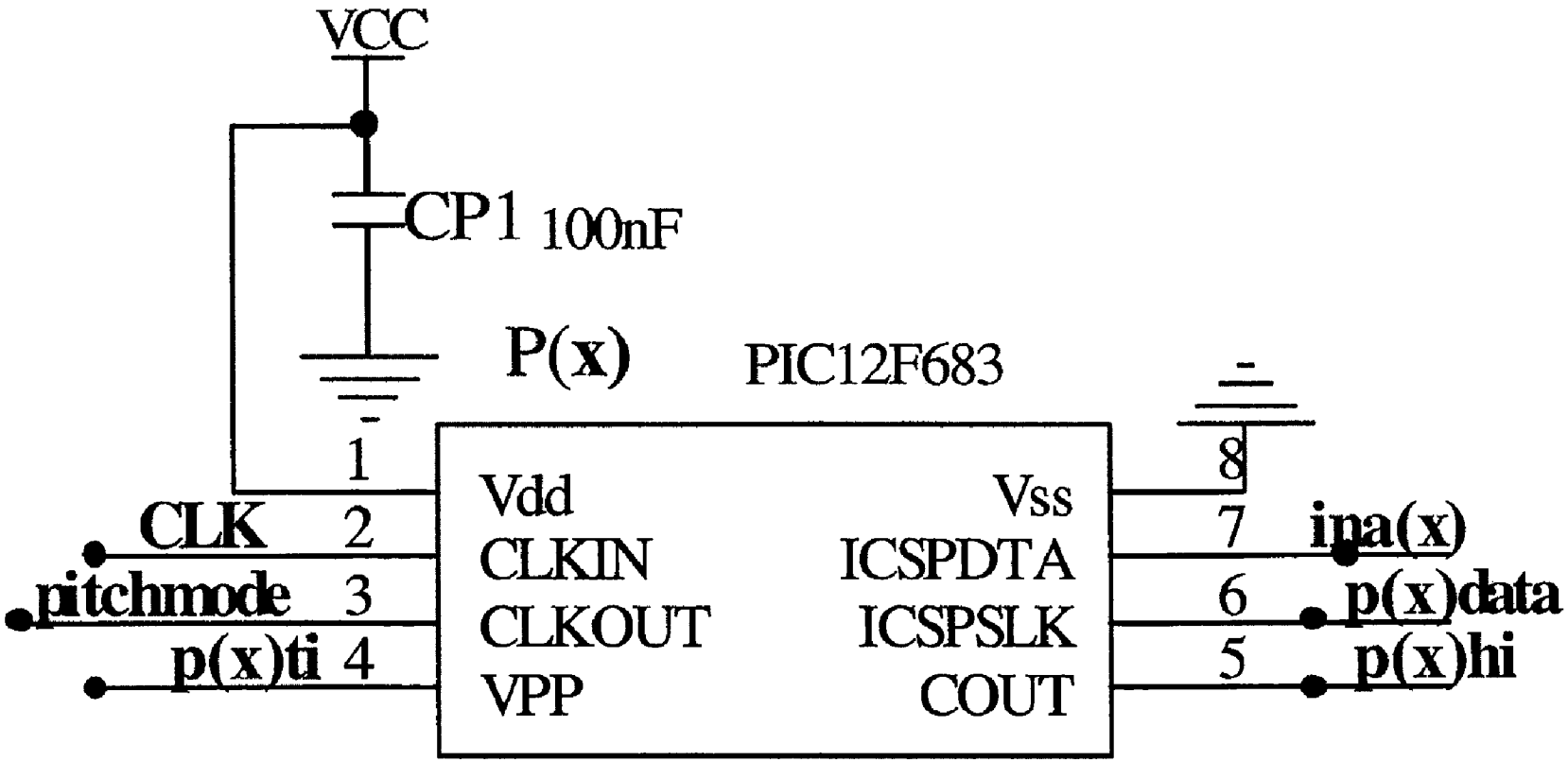
Figure 26:
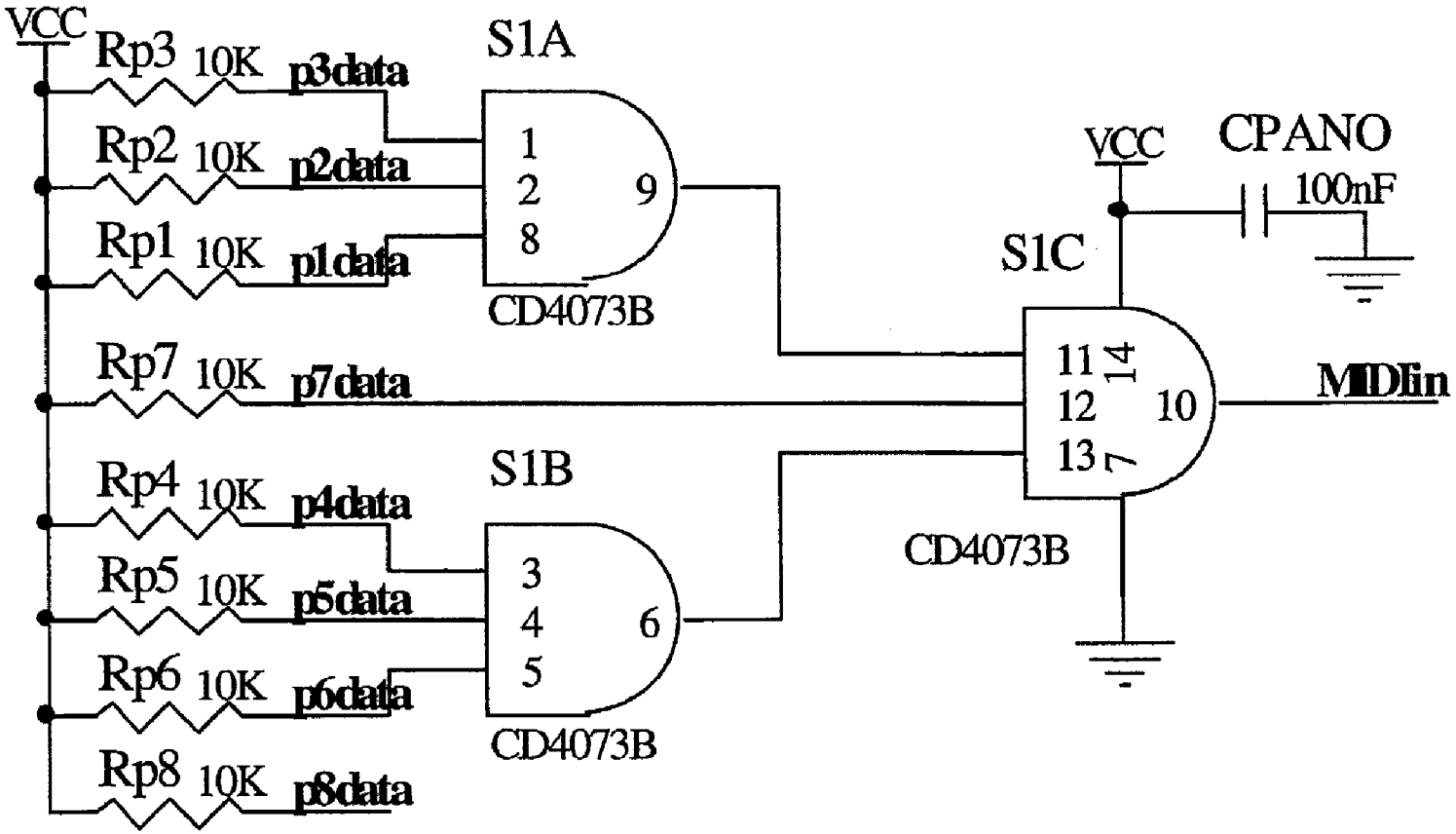

The schematic diagram of FIG. 19 shows an input filter and amplifier for a guitar high E string;

The schematic diagram of FIG. 20 shows an input filter and amplifier for a guitar B string;

The schematic diagram of FIG. 21 shows an input filter and amplifier for a guitar G string;

The schematic diagram of FIG. 22 shows an input filter and amplifier for a guitar D guitar string;

The schematic diagram of FIG. 23 shows an input filter and amplifier for a guitar A string;

The schematic diagram of FIG. 24 shows an input filter and amplifier for low E guitar string;

The schematic diagram of FIG. 25 shows one of six like low-capacity microcontrollers associated with one of circuits shown in FIGS. 19-24 that is used for processing the output of one of the circuits shown in FIGS. 19-24 using the techniques shown graphically in FIGS. 1-15;

The schematic diagram of FIG. 26 shows a digital logic circuit for collecting data from 6 low-capacity microcontrollers in an exemplary embodiment.

Figure 16:
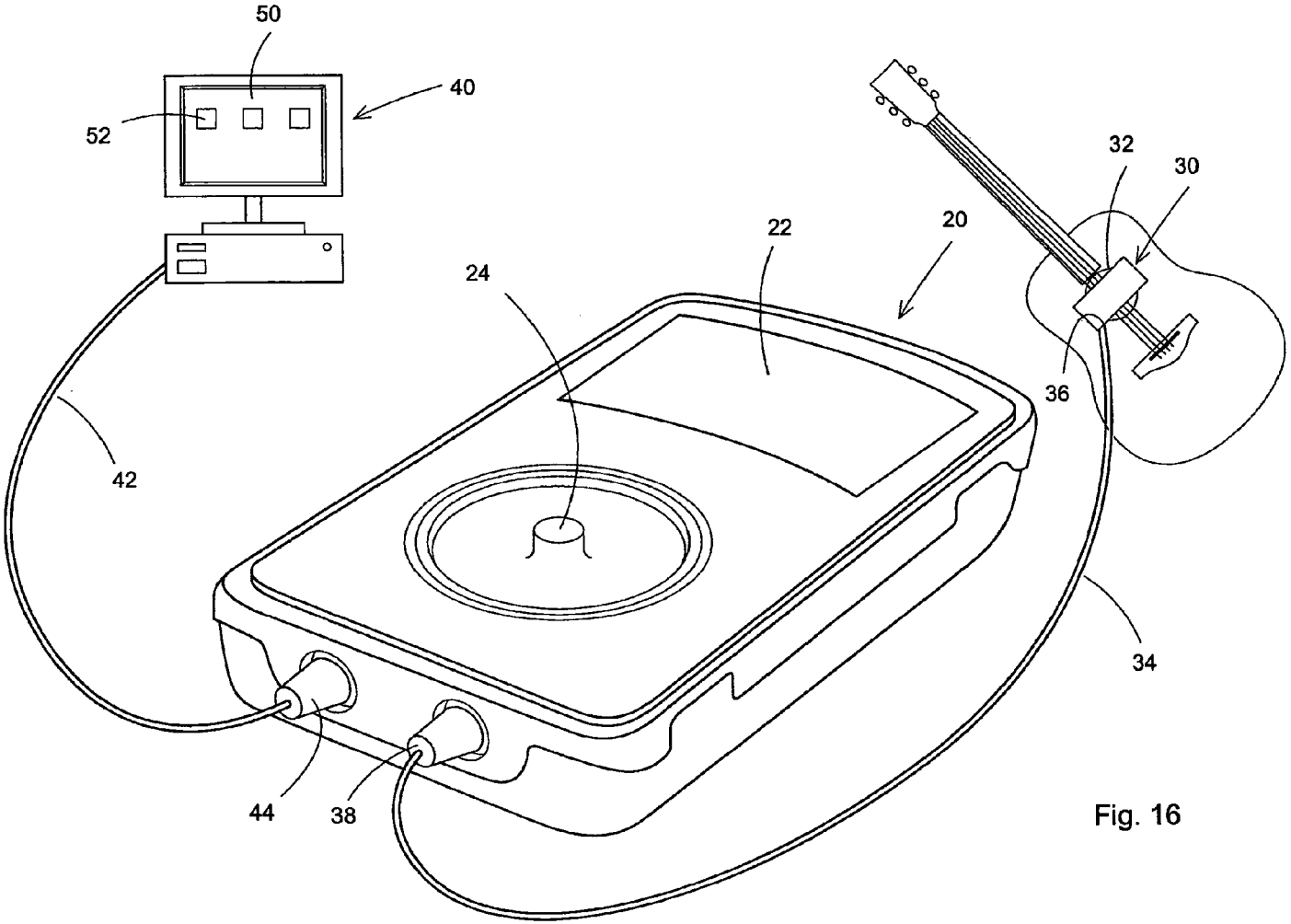
FIG. 16 shows an overall view of an exemplary embodiment of the music processing system, including a guitar with a pick-up, a controller and a computer.
Figure 27:
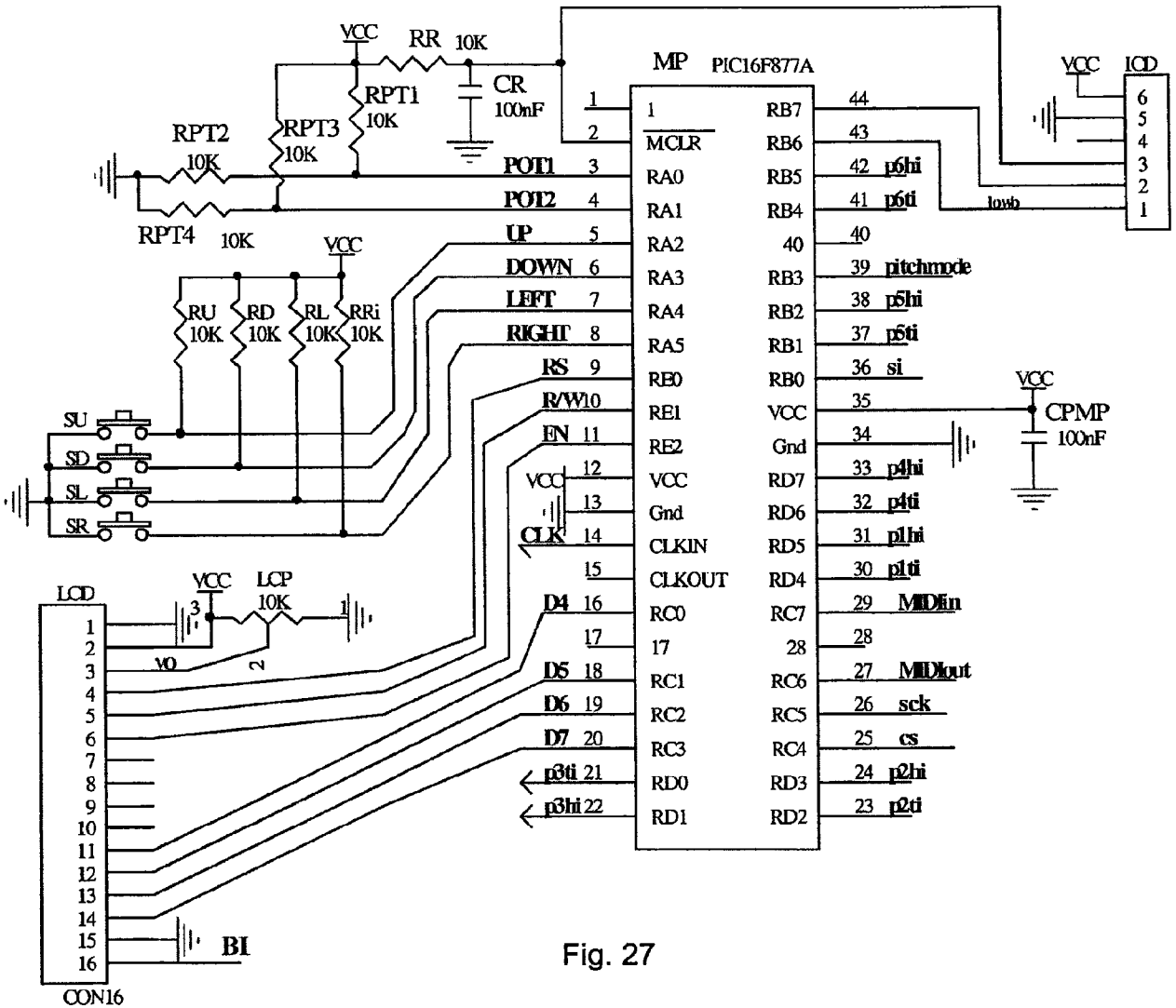
Figure 28:
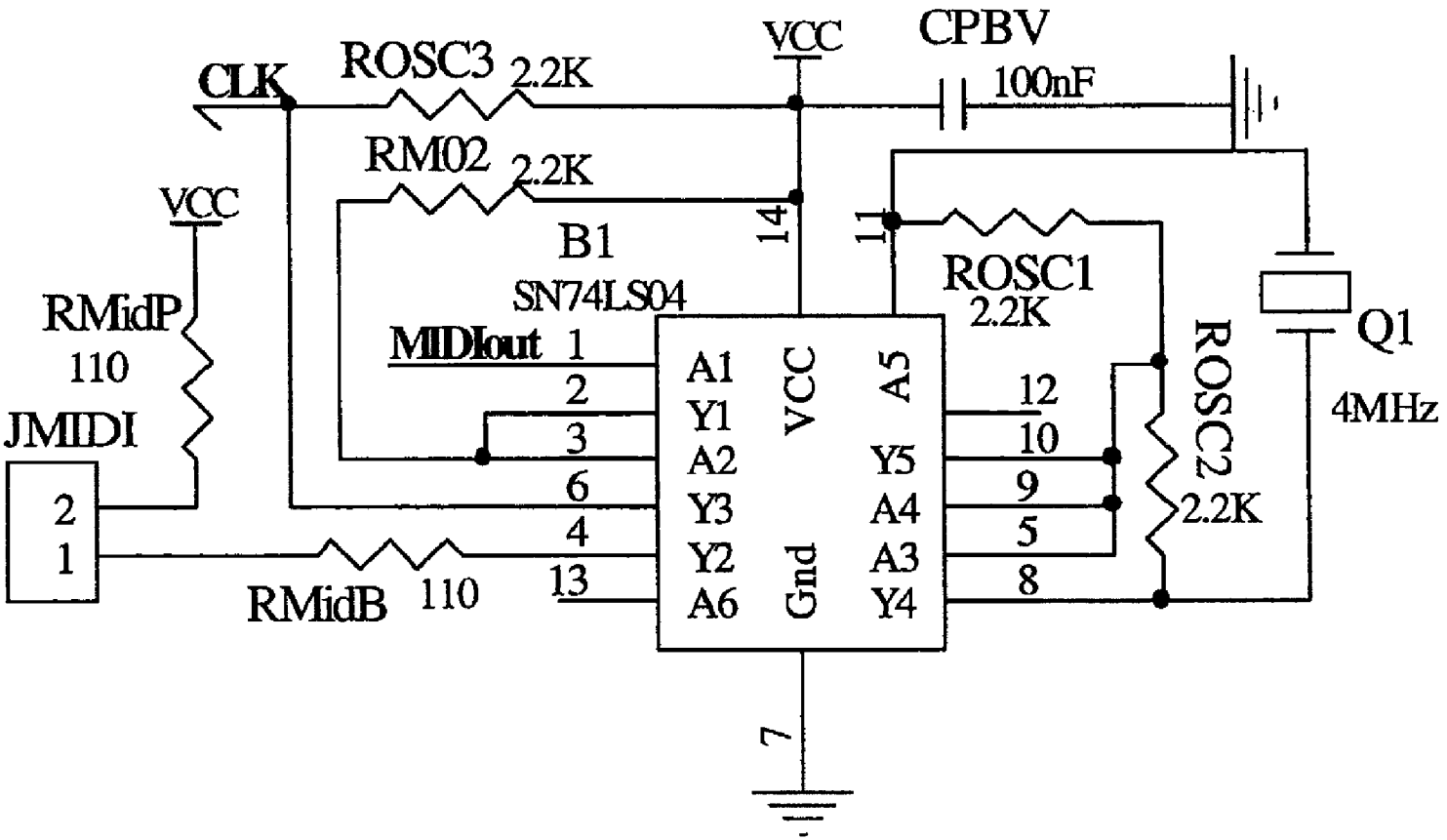
Figure 29:
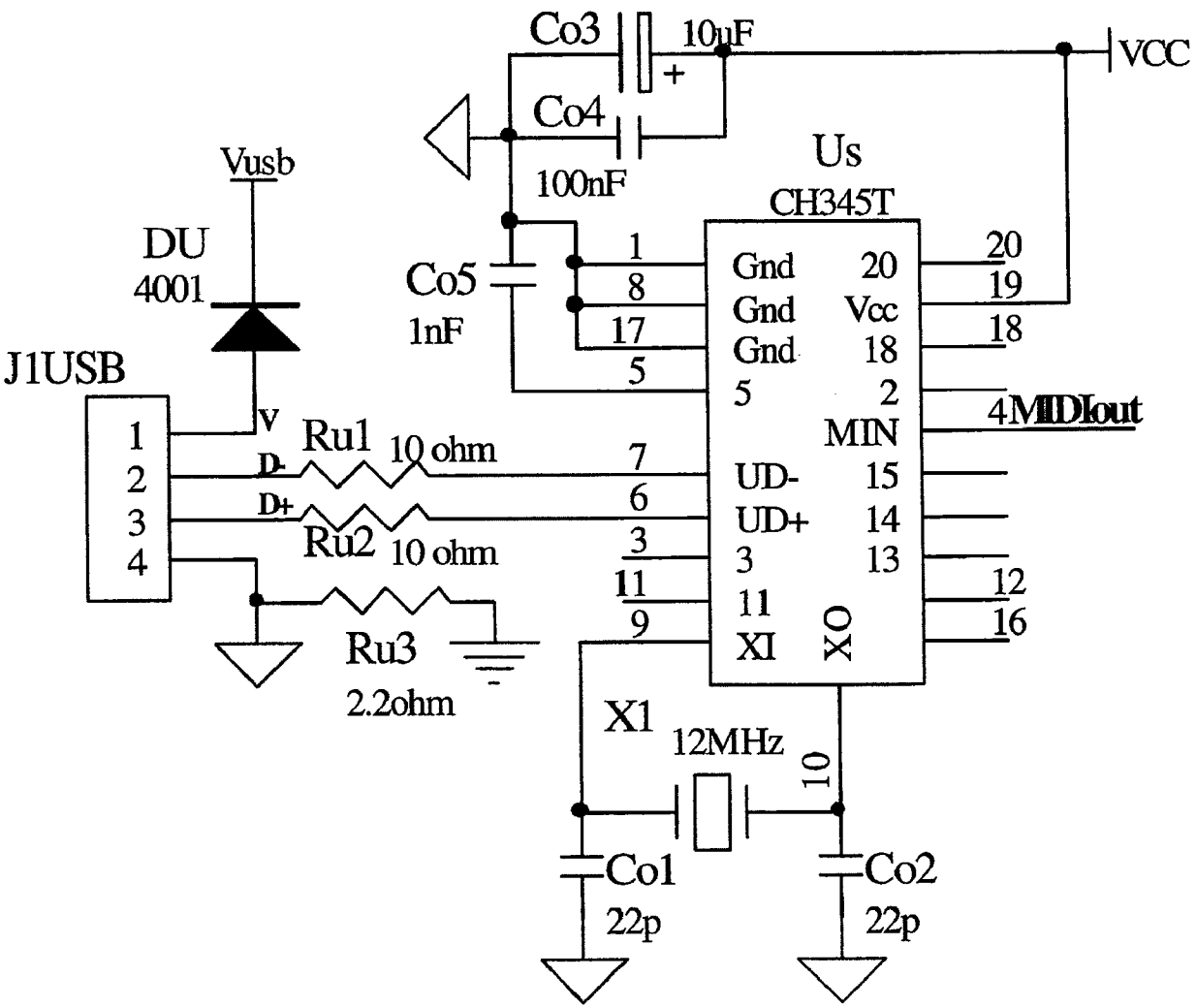
Figure 30:
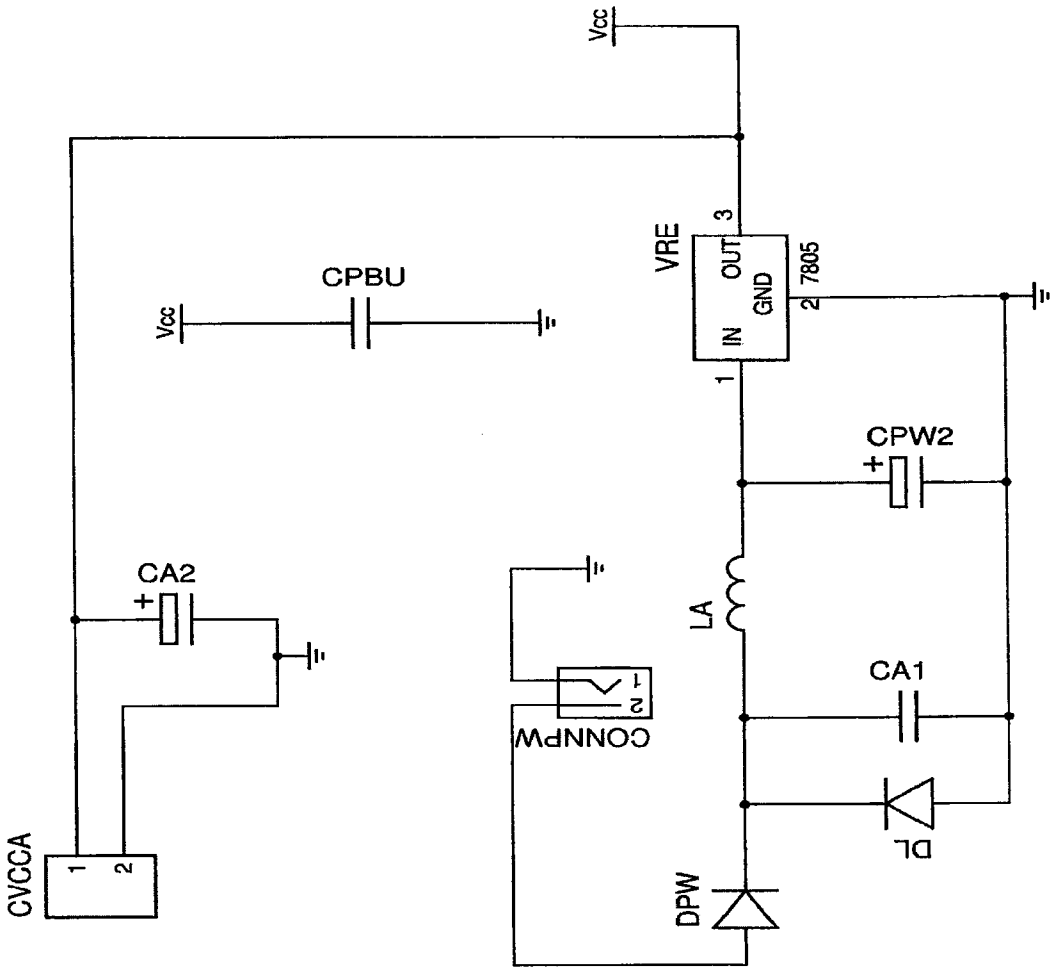

The schematic diagram of FIG. 27 shows an exemplary main microcontroller, and an LCD display and button actuators used in the controller of FIG. 16;

FIG. 28 shows an exemplary circuit for generating a clock signal CLK used by the microcontrollers of the controller;

The schematic diagram of FIG. 29 shows an exemplary circuit for providing MIDI output on a USB connector of the controller;

The schematic diagram of FIG. 30 shows a power supply circuit of the controller;

DISCLOSED EMBODIMENTS

The controller described herein is enabled to carry out the methods disclosed in U.S. application Ser. No. 11/873,970. Accordingly, each microcontroller generates an output MIDI command corresponding to the input signal. In accordance with that method, the input signal is amplified with constant amplification and value of triggers are changed as the input signal maximum and minimum changes. The method also defines fast input signal loss detection and criteria for multiple signal period detection. The method measures signal half period duration and based on two sums of half period determines multiple signal period. The method also defines minimum and maximum trigger values and initial trigger values which helps when input signal amplitude varies in time. The method of the present invention calculates maximum and minimum values of a input signal and then calculates positive and negative trigger values as a scaled-down maximum or a scaled-down minimum value of the input signal. The cross-point of the positive trigger level and the input signal curve is the point in time where positive signal half period duration measurement starts. Positive half period duration measurement ends at the next negative trigger level and input signal curve cross-point. During the positive half period duration measurement, the next positive trigger value is calculated. The measured positive half period is stored to a first free memory location. The cross-point of the negative trigger level and the signal curve is the point in time where the negative signal half period duration measurement starts. Negative half period duration measurement ends at the next cross-point of the positive trigger value and the input signal curve. During the negative half period measurement, the next negative trigger value is calculated. The measured negative half period is then stored to the next free memory location, after the positive signal half period. The positive half period measuring and then the negative half period measuring can be repeated several times.

The method disclosed in U.S. application Ser. No. 11/873,970 calculates the period by calculating two sums (S1 and S2) of the consecutive positive and negative half periods durations with an equal number of addends but with at least one different addend. Memory associated with each microcontroller will store the first measured positive half period duration in the first free memory location, the next negative half period duration in the next free memory location, the next positive half period duration in the next free memory location, the next negative half period duration in the next free memory location, and so on until signal loss is detected. Thus, as the positive and then negative half period durations appear in time with the input signal, they appear in memory in the same sequence. In other words, labeling the positive half period duration with P and the negative half period duration with N, the values are stored in memory in the order P1, N1, P2, N2, P3, N3, P4, N4, P5, and N5. P1 and N1 together form the first signal period duration. P2 and N2 together form the second signal period duration. P3 and N3 form third signal period duration. In accordance with the method and using one different addend when calculating the sum S1 and S2, the sum S1 may equal the sum of P1+N1+P2+N2. The sum S2 may be calculated as: (a) S2=N1+P2+N2+P3; (b) S2=P3+N3+P4+N4; or (c) S2=P2+N2+P3+N3. Although both sums S1 and S2 have 4 addends, sum S1 has at least one different addend. If the sum difference (S1−S2) is small enough, then any of two sums can be taken as a multiple signal period duration. The initial value of the positive trigger is above a minimum positive trigger value, which is above the input signal's DC component value. The initial negative trigger is under the maximum negative trigger value which is under the input signal DC component value. If during the half period duration measurement, the half period duration becomes greater than the maximum half period duration, then the measurement is stopped and signal loss is detected.

Figure 1A:
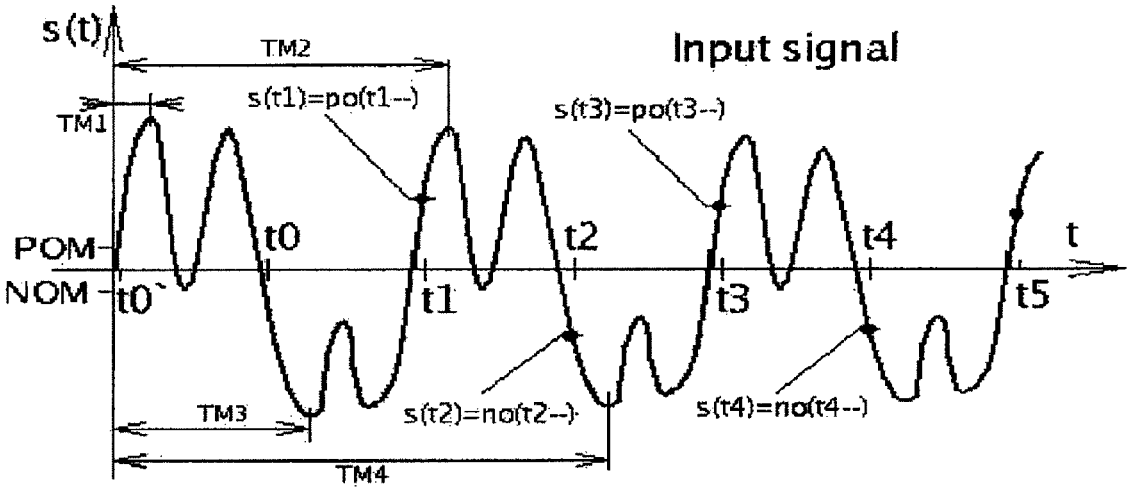
FIG. 1*a* shows a graph of input signal amplitude measured over time.
Figure 1B:
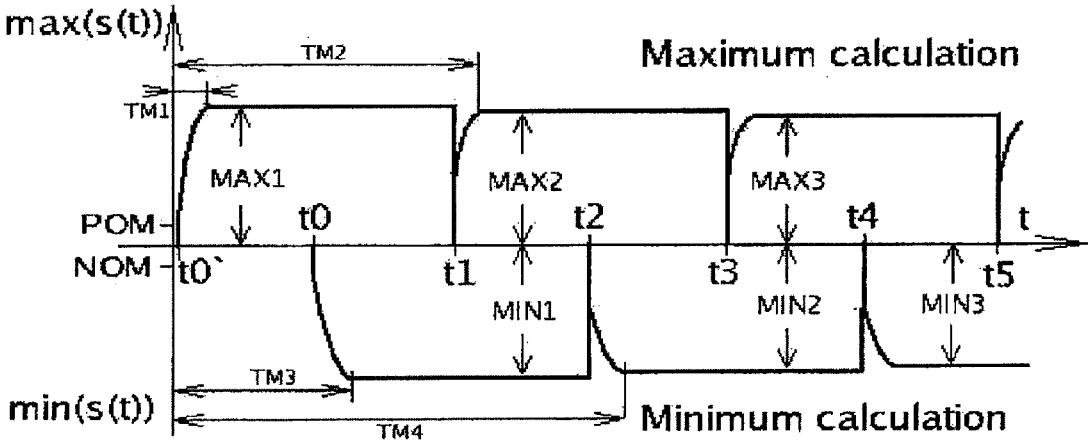
FIG. 1*b* shows a graph of the calculation of maximum input signal amplitude and minimum input signal amplitude over time.
Figure 1C:
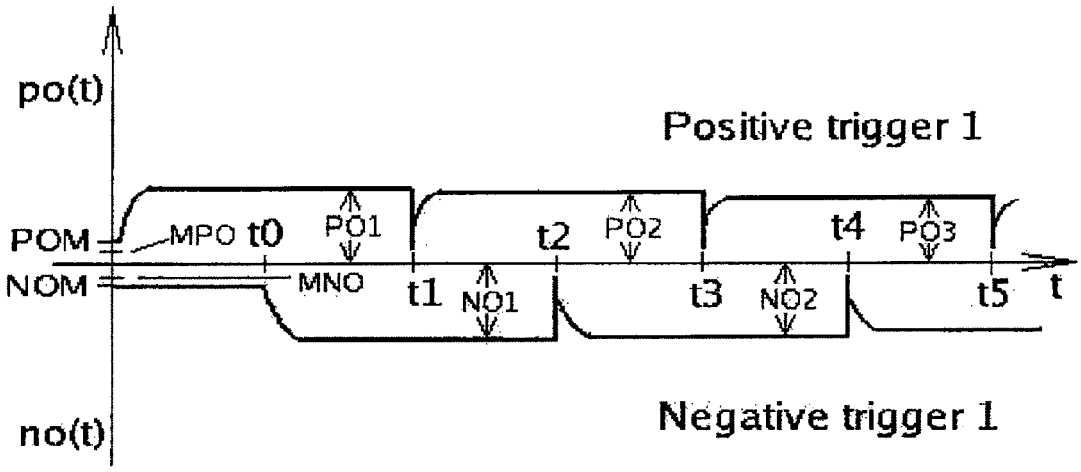
FIG. 1*c* shows a graph of the change in time of the positive and negative trigger value that is concurrently calculated with maximum input signal amplitude calculation.

FIG. 1*a* shows typical waveforms which will be used to describe the principles of the adaptive triggers method. In FIG. 1*a*, the amplitude of the input signal is shown with strong high harmonics and is plotted on the coordinate s(t), and a DC component level is plotting on the "t" coordinate (the "t" coordinate overlaps the DC component). In this method, the input signal maximum measuring starts when the input signal level becomes higher than the positive trigger level and ends when the input signal level becomes lower than the negative trigger level. FIG. 1*b* shows the wave form associated with the calculation of the maximum signal input and the minimum signal input as the functions max(s(t)) and min(s(t)). FIG. 1*c* shows the initial positive trigger value on the ordinate po(t) as value POM above the DC signal component level. FIG. 1*c* shows the minimum positive trigger value MPO which is lower and under the initial positive trigger value POM, and above the signal's DC component value. The next positive trigger value is calculated as a scaled down difference between the input signal maximum value and a DC signal component value added to the DC signal component value. If the calculation provides a positive trigger value less then minimum positive trigger value MPO, then the positive trigger value is set to minimum positive trigger value MPO. The next positive value can be calculated as a scaled down difference between the input signal maximum value and minimum positive trigger value MPO, which is then added to the minimum positive trigger value MPO. The points on the ordinate t1, t3, t5 are time points when the input signal value s(t) is higher (or higher or equal) than the positive trigger value po(t). If the positive trigger value po(t) is calculated concurrently with the maximum signal level calculation one may obtain a graph of positive trigger values as shown in FIG. 1*c*. When lower calculation power is important, the positive trigger values calculation can be performed in time periods when the input signal value becomes lower than the negative trigger value. The obtained value becomes the next positive trigger value. The last positive trigger value calculation principle is shown on FIG. 1D with the label Positive trigger 2.

Figure 1D:
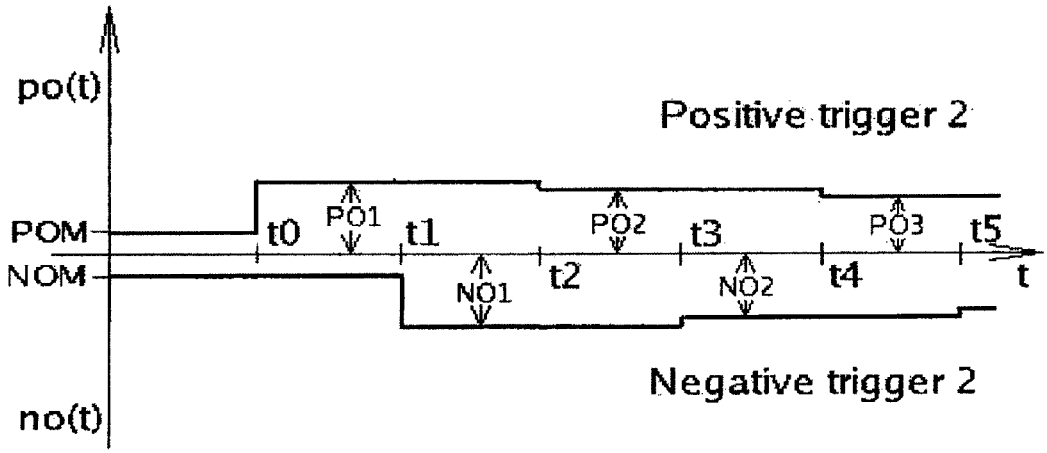
FIG. 1*d* show a graph of the change in time of the positive trigger value calculated at a point in time when the input signal value becomes less than the negative trigger value and the change in time of the negative trigger value calculated at a point in time when the input signal value becomes greater than the positive trigger value.

The initial negative trigger value is shown in FIGS. 1*a*-1*d* as NOM with a value less than the input signal DC component. The maximum negative trigger value MNO is less than the input signal DC component value and greater than the initial negative trigger value NOM. As will be discussed later, the next negative trigger value is calculated as a scaled down difference between the input signal DC component value and the input signal minimum value, which is then subtracted from the input signal DC component value. If the negative trigger value calculation gives a result that is greater than the maximum negative trigger value MNO, the negative trigger value is then set to the maximum negative trigger value MNO. The next negative trigger value may be calculated as a scaled down difference between the maximum negative trigger value MNO and the input signal minimum value, which is then subtracted from the maximum negative trigger value MNO. FIG. 1*c* shows a first case where the negative trigger value is calculated concurrently with the input signal maximum value calculation. FIG. 1*d* shows a second case where the negative trigger value is calculated when the input signal value is greater than the positive trigger value.

Further detail of one method is described below. The initial positive trigger value is set to a value POM and the initial negative trigger value is set to a value NOM. When the input signal value becomes greater than the positive trigger value (at time point t1), the positive half period interval measuring starts, the input signal value is acquired and the maximum signal value is changed if the newly acquired input signal value is greater than the current maximum signal value previously recorded. FIG. 1*b* shows the input signal maximum change over time with a curve that follows the input signal shape (one of curves starts in time point t1). When the input signal reaches its maximum value, the input signal maximum value becomes constant up to the next time point when the maximum half period measuring starts (time point t3 is the next point in time when the input signal maximum calculation starts). The input signal maximum calculation continues up to a point in time when the input signal value becomes less than the value of the negative trigger value (from after time point t2). After that time point, the calculated maximum has a constant value up to the next time point where the maximum calculation begins again (at time point t3). The next positive trigger value can be calculated concurrently with the input signal maximum calculation or at a time point when the input signal value becomes less than the negative trigger value. The positive half period duration comprises the time duration from time point t1 when the input signal value becomes greater than or equal to the positive trigger value (the positive trigger calculated at time point t0) up to time point t2 when the input signal becomes less than the negative trigger value (the negative trigger value calculated at time point t1). When the positive half period duration is measured, it is stored in next free memory location.

When the input signal value becomes less than the negative trigger value, the minimum signal calculation begins and measuring of the negative half period duration starts (time point t2). The minimum signal value is changed if the input signal value becomes less than the last remembered minimal signal value. This is shown in FIG. 1*b* with a curve that follows the input signal shape (curve starts from point t2). When the signal reaches its minimum value, the input signal minimum value becomes constant up to the next minimum calculation (up to time t4). Concurrently with the minimum signal calculation, the calculation of the next negative trigger value can be done, and in this case, the negative trigger value curve is proportional to the input signal minimum curve as shown in FIG. 1*c*. The negative trigger value can be calculated at the moment when the input signal value becomes greater than the positive trigger value. This case is also shown on FIG. 1*d*. The minimum calculation continues until the input signal value becomes greater than or equal to the positive trigger value (at time point t3). After that time point, the minimum holds the minimum calculated value. The negative half period measurement comprises the time interval from time point t2 when signal value becomes less than the negative trigger value (the negative trigger value calculated at time point t1) up to time point t3 when the signal value becomes greater than the positive trigger value (the positive trigger value calculated at time period t2). The measured negative signal half period duration is stored in the next free memory location.

After measuring the negative half period, the positive half period measuring, the maximum signal value calculation and the next positive trigger value calculation starts again as described above. The end of the positive half period duration measuring is the same time point as the start of the negative half period duration measuring. The end of the negative half period duration measuring is the same time point as the start of positive half period duration measuring. The measuring of the positive half period duration and then the negative half period duration is repeated several times one after another, and the measured positive and negative half period duration values are recorded in consecutive free memory locations. The measuring of the positive or negative half period durations is stopped when the measured maximum and minimum values of the input signal are between maximum negative and minimum positive trigger values. In such a case, it is not possible to measure half period duration as there are no cross-points of the input signal curves with the curves of the negative and positive trigger values. The positive and negative half period measuring can also be stopped, if the value of the positive or negative measured half period duration becomes greater than the maximum half period duration. This may also mean that signal has disappeared, or that the signal amplitude is so small as to be non-existent.

After consecutive positive and negative half period durations are measured and recorded in memory, signal period calculation starts. A first sum is formed from consecutive positive and negative half period duration values recorded in memory in consecutive memory locations, and a second sum is formed from consecutive positive and negative half period duration values recorded in memory in consecutive memory locations. Both sums comprise equal number of positive and negative half periods. Each sum has an equal number of positive and negative half period duration values. However, the addend of the first sum may be the second or the third measured half period duration stored in memory. As described above, positive half period duration values P(n) and negative half period duration values N(n) are stored in memory in the order P1, N1, P2, N2, P3, N3, P4, N4, P5, and N5. P1 and N1 together form the first signal period duration. P2 and N2 together form the second signal period duration. P3 and N3 form third signal period duration. In accordance with the method and using one different addend when calculating the sum S1 and S2, the sum S1 may equal the sum of P1+N1+P2+N2. The sum S2 may be calculated as: (a) S2=N1+P2+N2+P3; (b) S2=P3+N3+P4+N4; or (c) S2=P2+N2+P3+N3. Although both sums S1 and S2 have 4 addends, sum S2 has at least one different addend. Thus, the first sum S1 consists of 2N consecutive positive and negative half periods stored in consecutive memory locations. The first half period duration value of the second sum S2 (previous example (a)) is the half period duration value stored in memory as the N1 half period duration value, which occurs after the first half period duration value of the first sum, i.e., P1. The first half period duration value of the second sum S2 can be stored in memory after last half period duration value of the first sum S1 but the first half period duration value of the second sum S2 can be also one of the first sum S1 half period duration values. As will be described, memory associated with the microcontroller contains values associated with the positive half period duration value, then the negative half period duration value, then the positive half period duration value, then the negative half period duration value, and so on. In other words, consecutive half period duration values are a positive half period duration value followed by a negative half period duration value, for instance, two positive half periods are separated by at least one negative half period. Thus, the memory contains in consecutive memory locations, consecutive half periods, e.g. a positive half period after a negative half period or a negative half period after a positive half period. If the difference between the two sum (i.e., S1−S2) is less than the given value D, then one of sums can be considered as N signal periods. In the example, the value D is 1/64 of the either calculated sum S1 or S2 (so D=1/64*S1 or D=1/64*S2). The value D can be adjusted so that detection criteria can be adjusted to various signal types. The sum difference (i.e., S1−S2) can be less than the value D or greater than the value D, but if, during the half period measuring, none of the stop criteria described above becomes applicable, the method considers that the input signal still exists, and the positive trigger value is set to the minimum positive trigger value MPO, the negative trigger value is set to the maximum negative trigger value MNO, the maximum and minimum signal values are set to the DC signal level component, and the positive half period measuring starts again as described above.

Figure 2A:
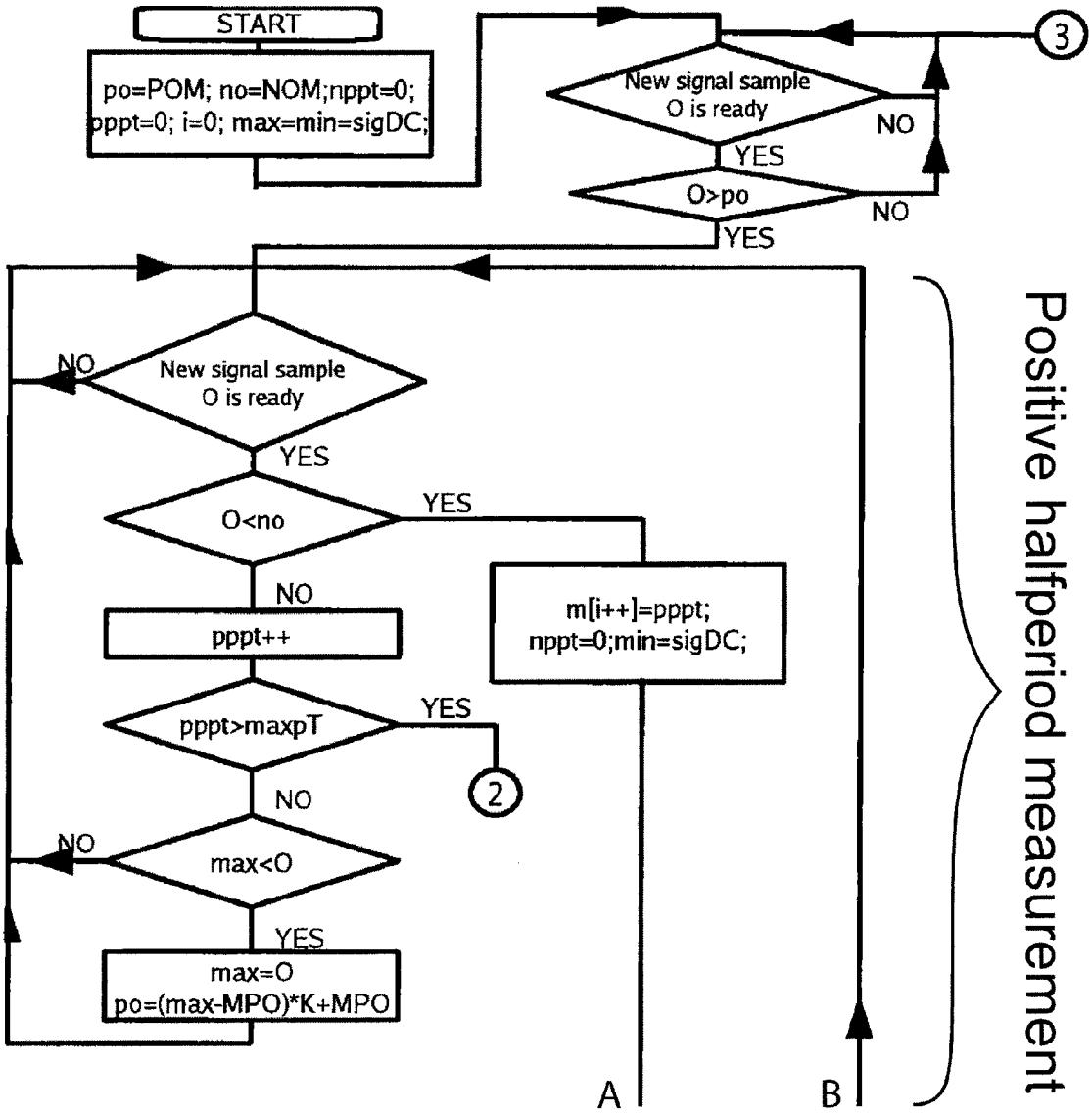
FIG. 2 shows a flow chart of the method described in this document where positive and negative trigger values are concurrently calculated with maximum and minimum input signal amplitude calculation.
Figure 2B:
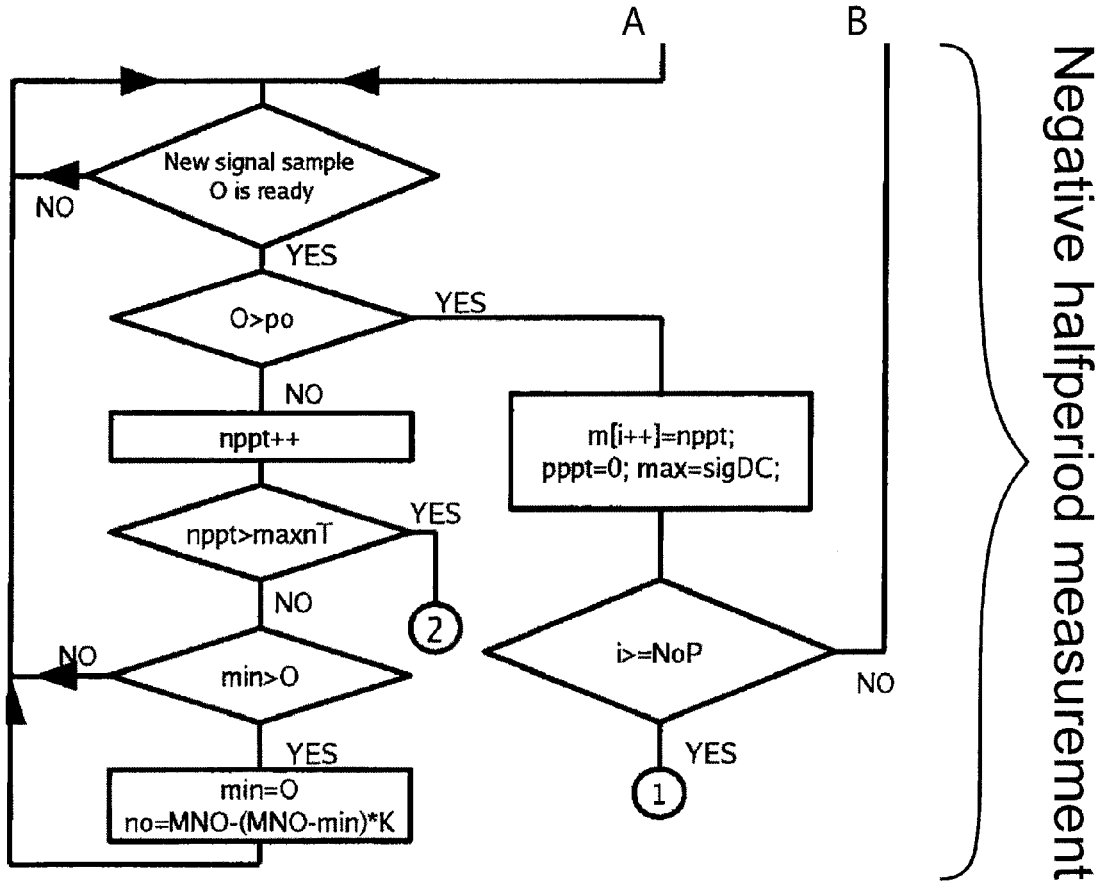
Figure 2C:
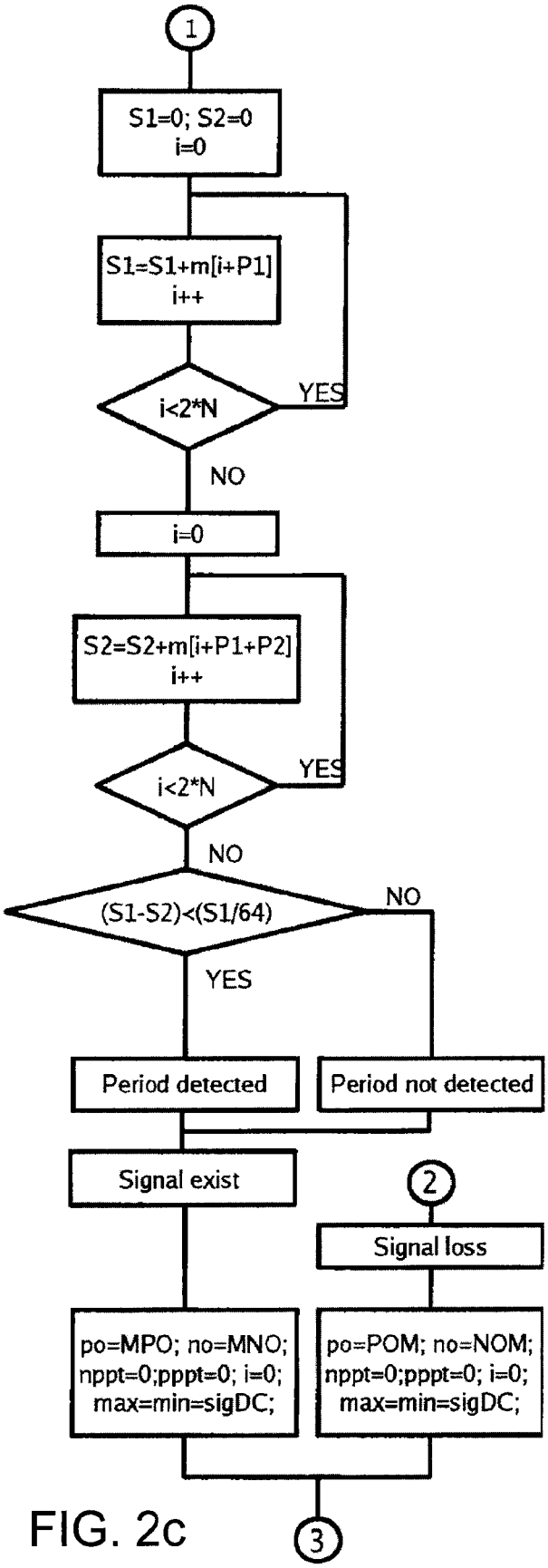

FIG. 2 shows one algorithm that calculates trigger values concurrently with the maximum calculation. The algorithm begins with setting the initial values of the following variables: variables "max" and "min", (max is maximum signal value and min is minimum signal value) are set to the DC signal component value (max=min=sigDC); variable "po" is the positive trigger value with an initial value of POM; variable "no" is the negative trigger with initial value of NOM; both half period duration variables "pppt" and "nppt" are initially set to a 0 value. Half period duration is measured with sample numbers. Computation using this algorithm needs a computer with enough computational power so that the calculations between the two sample times can be done. After the initial variables are setup, the algorithm waits until the input signal becomes greater than the positive trigger values of variable "po."

The first part of the algorithm measures the positive half period duration and waits for the input signal value to be less than the negative trigger value, when the negative half period duration measuring can start. When the new sample is ready, the sample is entered in register O, the algorithm checks if the sample value is less than the negative trigger value stored in variable "no." If the sample value is less than the negative trigger variable value "no," then the positive half period measuring is finished, the measured positive half period duration variable "pppt" is stored to the first free location in memory "m," and the measuring of negative half period duration starts. If the sample value is greater than the negative trigger value "no," the variable "pppt" is incremented. If the measured half period duration is not greater than the maximum positive half period duration constant "maxpT," the algorithm continues with the input signal maximum calculation. If last remembered value of variable "max" is less than the current sample value, then the variable "max" is set to the current sample value O, and the new positive trigger value is calculated. If the sample value is less than the last remembered value of the variable "max", the algorithm waits for the next ready sample O.

During transition from the positive half period duration measuring to negative half period duration measuring, the variable "nppt" is set to value zero. As in the positive half period duration measuring, in the negative half period duration measuring, the algorithm waits for a new input signal sample in variable "O." When the sample variable "O" is ready, the algorithm checks if the sample value is greater than the positive trigger value calculated during the previous positive half period duration measuring. If the sample value is greater than the positive trigger value, then the negative half period duration measuring ends, the measured negative half period duration value is stored to first free location in array "m," and the measured value of the positive half period duration variable "pppt" is set to zero to be prepared for next positive half period duration measuring. If the new sample value is not greater than the positive trigger value, the negative half period measuring continues, the variable "nppt" is incremented (the variable "nppt" presents negative half period duration value). If the new value of the variable "nppt" is not greater than the value of the constant "maxnT", the algorithm continues with checking if the last remembered minimum value of variable "min" is greater than the value of the new sample variable "O." If it is, the variable "min" is set to the value of the current sample variable "O," and the new value of the negative trigger variable "no" is calculated. If the last recorded minimum value of variable "min" is less than the value of the sample variable "O," then the algorithm waits for a new value of sample variable "O." The positive or negative half period duration measuring is stopped if the measured half period durations becomes greater than the value of the given maximum half period duration constants "maxpT" and "maxnT."

After measuring a number of consecutive positive and negative half period durations equal to the value of NoP, the algorithm continues with the S1 and S2 sums calculation. 2N consecutive half periods duration values are added to each sum (positive and negative half periods). Sum S1 starts summing from half period duration value recorded in member m[P1] in array memory "m." Sometimes the first measured half period duration value stored in m[0] array member is not correct and the first half period duration value of sum S1 will not be considered as the first recorded half period duration value of memory m[0]. The first half period duration value of the second sum S2 is shifted to the P2 addend (or the member) from the first half period duration value of the first sum S1. The constant P2 is always greater than zero. After forming the sum S1 and S2, the algorithm checks if the difference between S1 and S2 is greater than 1/64 of the S1 sum. If it is, the sum S1 or S2 represents the "N" signal period duration. If the calculated difference is not less than 1/64 of the sum S1, then the signal period duration is not detected. The part of the sum or some other small value taken as a limit, which must be less than the difference of the sum of S1 and S2, may be used as a decision criteria for calculating the signal period duration, and can depend on the input signal waveform and sometimes must be experimentally determined. The number of addends or members "NoP" in the array "m[ ]" must be greater than the sum P1+P2+2N to ensure a correct sum calculation. If during the half period duration measuring, the half period stop criteria is not achieved, the positive trigger value can be set to the minimum positive trigger value, the negative trigger value can be set to the maximum negative trigger value (setting the negative and the positive trigger value is not mandatory), the maximum signal variable "max" and the minimum signal variable "min" are set to the DC input signal component value, and the positive half period duration measuring starts again.

Figure 3A:
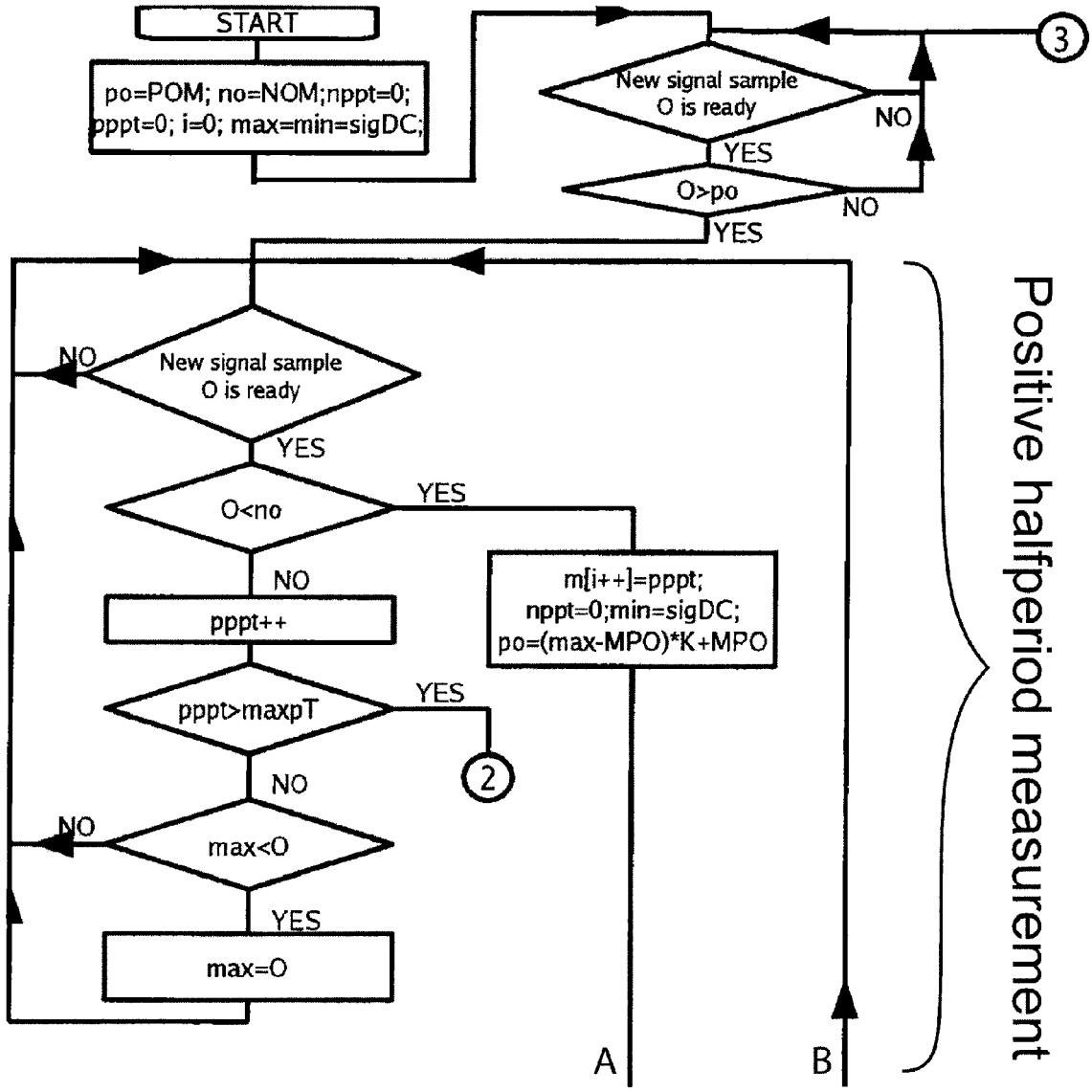
FIG. 3 shows a flow chart of the method described in this document where positive and negative trigger variable are calculated at a point in time where the input signal becomes greater then positive trigger or becomes less then negative trigger.
Figure 3B:
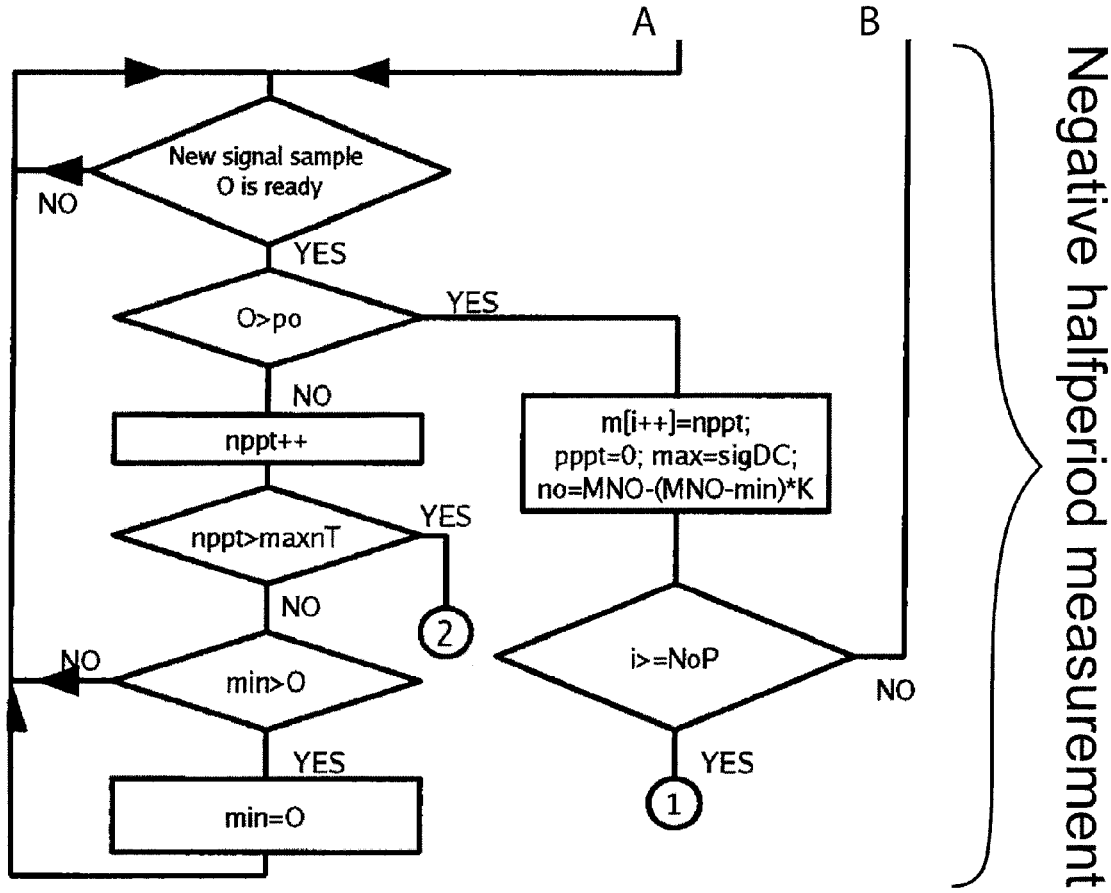
Figure 3C:
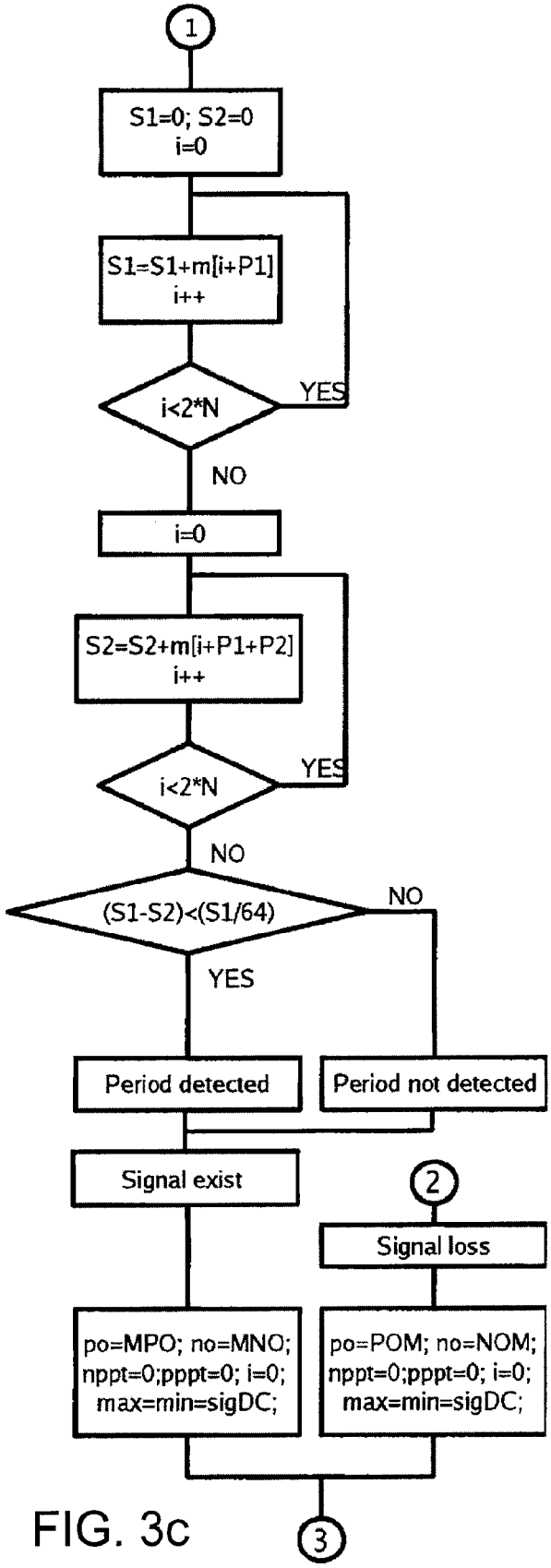

FIG. 3 shows an algorithm with the trigger value calculation at a point in time where the input signal becomes greater than the positive trigger value or less then negative trigger value.

The algorithm will be explained in connection with the microcontroller memory devices of FIG. 4, FIG. 5, FIG. 6, FIG. 7, FIG. 8, FIG. 9, FIG. 10, FIG. 11, FIG. 12, FIG. 13, FIG. 14, FIG. 15. Each of the FIGS. 4-15 shows an input analog low pass filter (triangle with "F" label), an Amplifier with constant gain A (triangle with "A" label), and a virtual microcontroller. The virtual microcontroller contains an AD converter (triangle with "AD" label), an 8-bit AD conversion register labeled as "O," and a plurality of 8 bit registers marked to correspond with the variables in the algorithm. The amplifier and filter are adjusted so that the amplifier output voltage level is one half of the AD converter input voltage range when no input signal is present at the filter input. Also the filter will pass only time variable signal components to the amplifier. As a result, one AD converter is needed for input of AC input signal components, which oscillate around one half of the AD converter input voltage range. Also, the algorithm assumes that the "t" coordinate for all of the curves shown in FIGS. 1*a*-1*d* overlap one half of the AD converter voltage range. Before the algorithm starts, the register "sigDC" contains a binary number corresponding to the AD conversion of the DC input signal value. The algorithm assumes that the microcontroller is sampled and converted to a binary number input corresponding to a DC level that is one half of the AD input range, when no signal is present at the filter input. As stated above, the binary number input is stored to register "sigDC." The measured positive half period duration is a 16 bit variable "pppt" and in the virtual microcontroller, the variable "pppt:h" is the high 8 bits, and the variable "pppt:l" is the low 8 bits. The measure negative half period duration is a 16 bit variable "nppt" and in the virtual microcontroller, the variable "nppt:h" is the high 8 bits, and the variable "nppt:l" is the low 8 bits.

Figure 4:
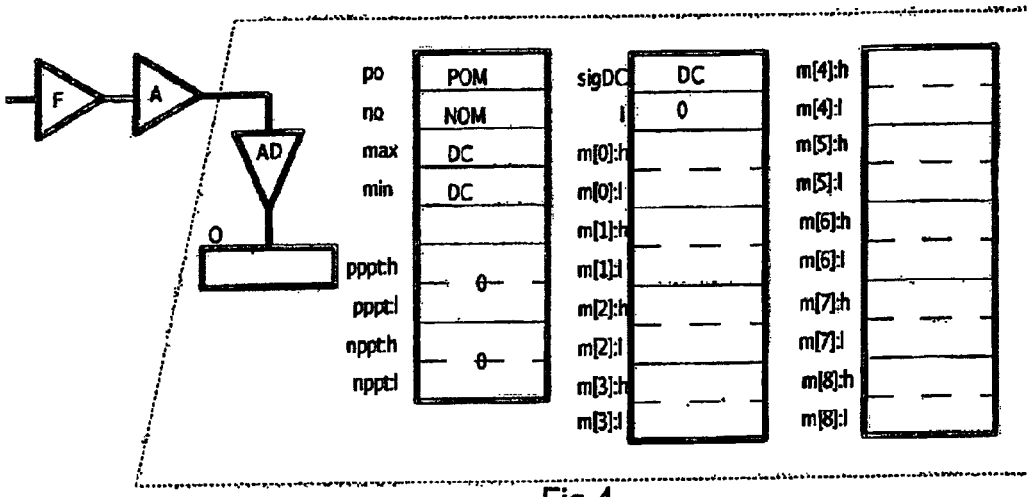
FIGS. 4 to 15 show changes over time of a microcontroller's registers.

After initial register setup as shown in FIG. 4, the algorithm waits until the input signal becomes greater than variable "po," which is set to the value "POM." The input signal on FIG. 1*a* becomes greater than the value "POM" after "t0". A new condition of the microcontroller is shown in FIG. 5 in that the AD converter register "O" is set with value S(t0') for an input signal sample value.

Figure 5:
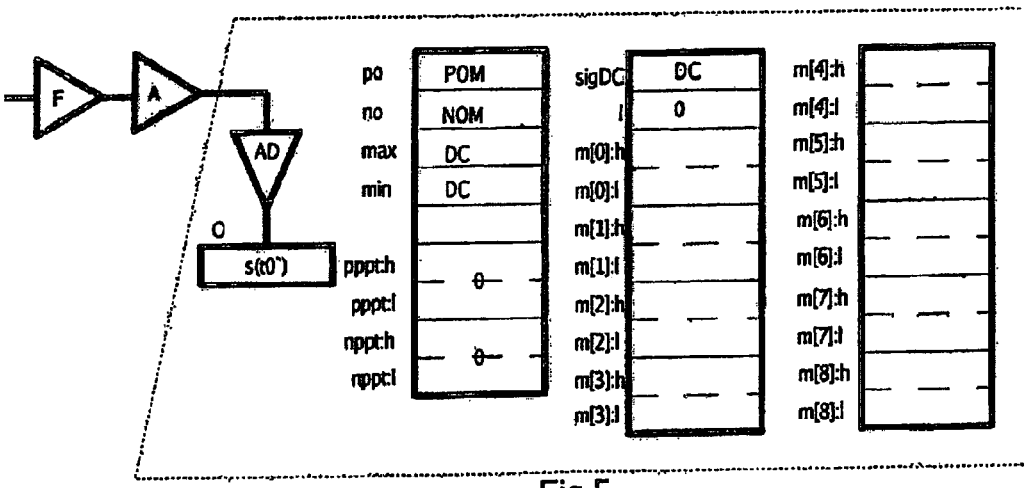
Figure 6:
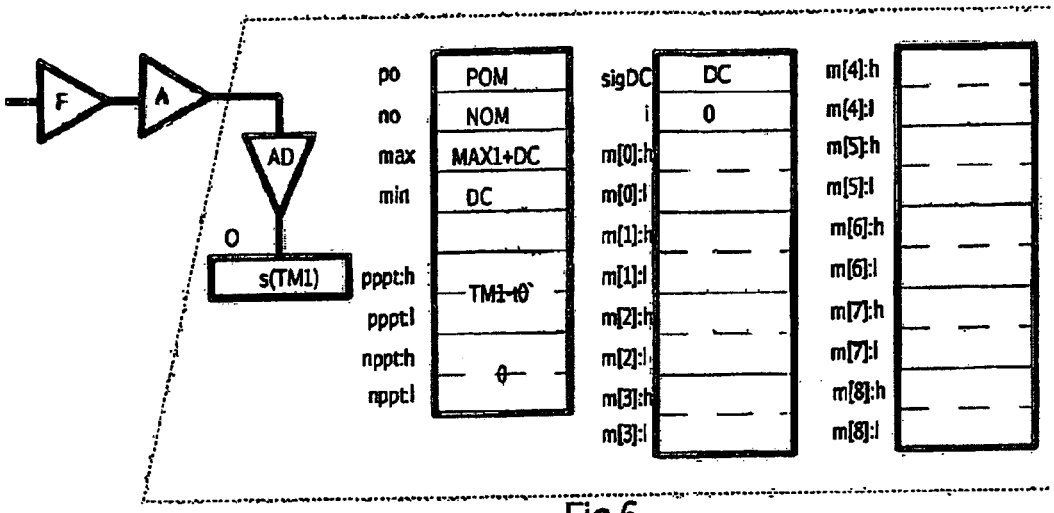
Figure 7:
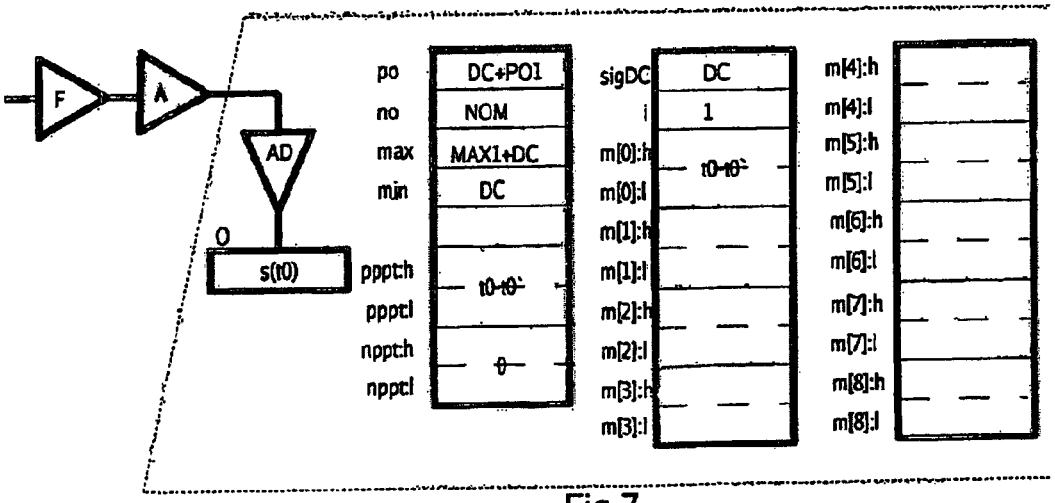

The positive half period duration measuring portion of the algorithm on the virtual microcontroller is illustrated in FIG. 5, FIG. 6, FIG. 7. FIG. 5 shows the microcontroller registers when the positive trigger value "po" just passes sample time "t0'". The maximum calculation starts and the positive half period duration measuring starts. As described above, the maximum register "max" will be set to new sample value if the new sample value is greater than the last sample value in register "max." On FIG. 1, from sample time "t0'" to sample time TM1, the value in the register "max" in the microcontroller changes until the maximum signal at sample time TM1 is reached in first signal period. After the TM1 sample, the value in register "max" in the microcontroller is not changed and the value in register "max" is set to MAX1+DC value (the "t" coordinate is DC signal level).

The microcontroller registers at the TM1 sample time are shown on FIG. 6. Sample TM1 is shown in register "O", and value MAX1+DC is shown in register "max", which is TM1 sample value. As shown on FIG. 1, after the TM1 sample, the value in microcontroller register "max" is not changed and has a value corresponding to MAX1+DC because all of the next signal samples up to sample time t1 are less then the value of MAX1+DC. The next characteristic point in the algorithm is taken at sample time t0 when input signal value becomes less then the negative trigger value stored in the register "no." At sample time t0, the input signal sample is less then value in the register "no." FIG. 7 also shows a new positive trigger value, which is calculated and stored in register "po" as a value corresponding to DC+PO1 (po=(max−MPO)*k+MPO, k=1/2). This new positive trigger will be used at sample time t1. This new state in the microcontroller registers is shown in FIG. 7. Also the 16 bit register "pppt" has a value corresponding to t0−t0' that corresponds to the number of samples between sample t0' and t0. Thus, in register "pppt", the positive half period duration in sample numbers is stored. This positive half period duration is stored to the 16 bit register m[0] and pointer I is incremented to point to the next free register to store the next negative half period duration. In the 16 bit register m[0], m[0]:h corresponds to the high 8 bits and m[0]:I corresponds to the low 8 bits.

Figure 8:
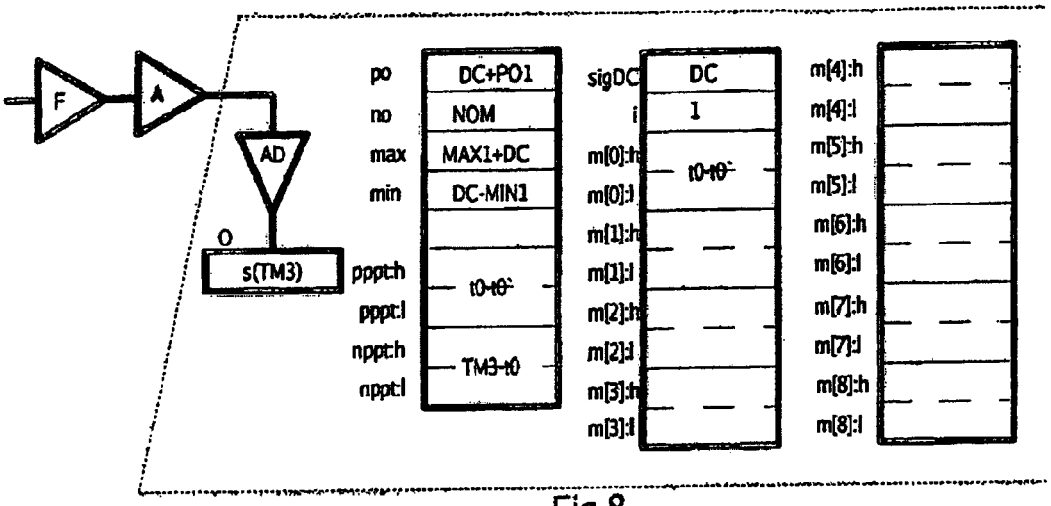
Figure 9:
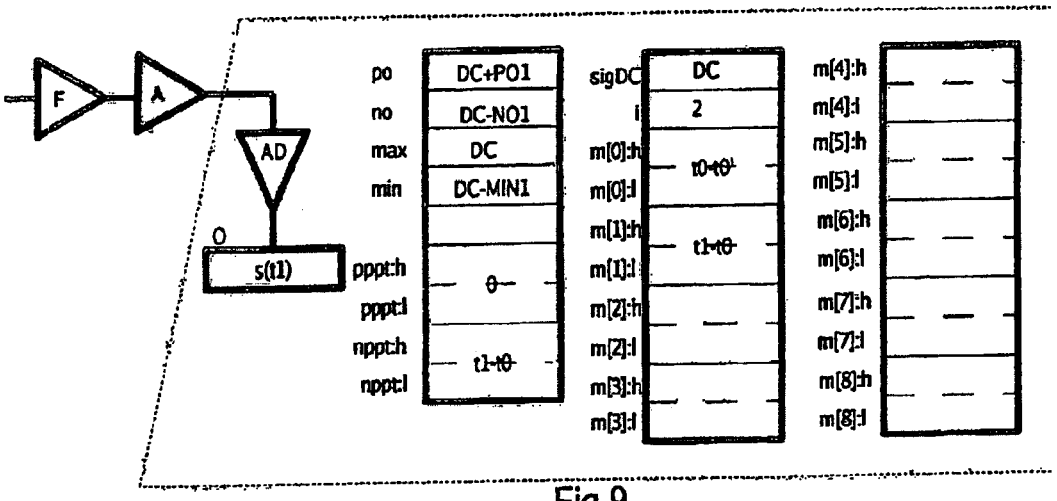

The algorithm for measuring the negative half period on the virtual microcontroller is illustrated in FIG. 7, FIG. 8, FIG. 9. FIG. 7 shows microcontroller registers when negative trigger value "no" is passed at sample time t0. At that time, the minimum calculations starts and the negative half period duration measuring starts. As will be described below, the minimum register "min" will be set to new sample value if new sample value is less than the last sample value stored in register "min". On FIG. 1, from sample t0 to sample TM3, the register "min" in the microcontroller also changes, and at the TM3 sample, the minimum signal is reached in first signal period. After the TM3 sample, the register "min" is not changed and the value in register "min" corresponds to DC−MIN1. The t coordinate overlaps the DC signal level. The TM3 sample microcontroller registers are shown in FIG. 8. In register O, the TM3 sample is stored and in MIN register, the value DC−MIN1 is stored, which corresponds to the TM3 sample value. As shown on FIG. 1, the curve "Minimum calculation", after the TM3 sample, the value stored in register "min" is not changed and has a value corresponding to DC−MIN1 because all of the next signal samples to sample time t2 are greater then DC−MIN1. The next characteristic point in the algorithm is at sample time t1, when the input signal value becomes greater then positive trigger value "po." At sample time t1, the input signal sample is greater than the value stored in register "po." Register "po" contains the positive trigger variable calculated at point t0. A new negative trigger value is calculated and stored in register "no" as value DC−NO1, (no=MNO−(MNO−min)*K, K=1/2). This new negative trigger will be used at sample time t2. This new state in the microcontroller registers is shown in FIG. 9. Also the 16 bit register "nppt" contains a value corresponding to t1−t0. The value t1−t0 is number of samples between sample times t0 and t1. So in the register "nppt", the negative half period duration is stored in sample numbers. This negative half period duration is stored to 16 bit registers m[1] and pointer I is incremented to point to next free registers to store the next positive half period duration.

After the first signal period, the positive and negative trigger values are proportional to the maximum and minimum signal level. The next calculation steps use the positive and negative trigger values that are proportional to maximum and minimum signal values, thereby providing precise period measurement.

Figure 10:
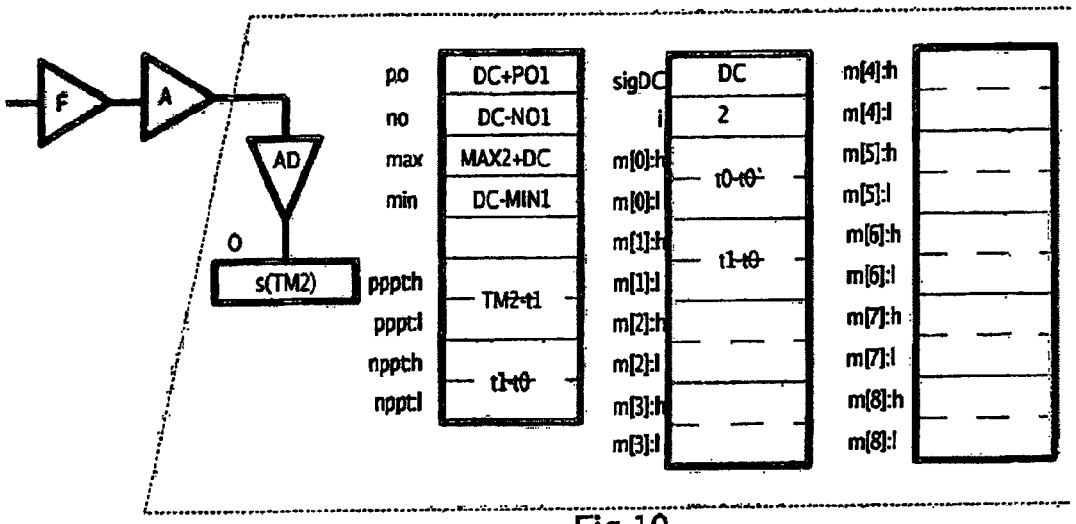
Figure 11:
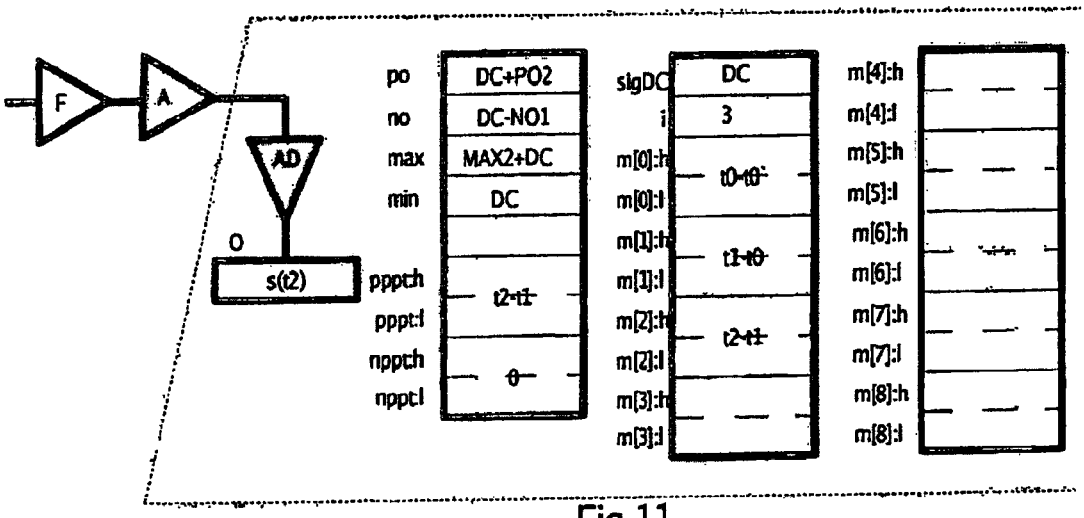

The positive half period measurement on the microcontroller after sample time t1 is illustrated on FIG. 9, FIG. 10, and FIG. 11. FIG. 9 shows the microcontroller registers when the positive trigger value po is passed at sample time t1. Thus, the positive trigger value is proportional to the signal maximum in the previous signal period. At sample time t1, the maximum calculation starts and the positive half period duration measuring starts. As will be described below, the maximum register "max" will be set to a new sample value if the new sample value is greater than the last sample value stored in the register "max". From sample t1 to sample TM2, the value stored in register "max" changes. The TM2 maximum signal is reached in second signal period. After the TM2 sample, the register "max" is not changed and the value stored in register "max" corresponds to MAX2+DC where the t coordinate is the DC signal level. The registers at the TM2 sample time are shown on FIG. 10. In register O, sample TM2 is stored, and in register "max", value MAX2+DC value is stored. After the TM2 sample, the microcontroller register "max" is not changed and has a value corresponding to DC+MAX2 because all of the next signal samples to sample time t3 are less than the value DC+MAX2. The next characteristic point in the algorithm is at sample time t2 when the signal value becomes less than the negative trigger value no. At sample time t2, the input signal value sample is less than the value in register "no", which corresponds to the negative trigger variable. The new positive trigger value is calculated and stored in register "po" as PO2+DC. This new positive trigger value will be used in sample time t3.

This new state in the microcontroller registers is shown in FIG. 11. The register "pppt" contains a value t2−t1. The "t" coordinate shows the sample number. Thus, t2−t1 is number of samples between sample time t1 and t2. In register "pppt", the positive half period duration in sample numbers is stored. This positive half period duration is stored to 16 bit registers m[2] and pointer I is incremented to point to the next free register to store the next negative half period duration. Also, 16 bit register "nppt" is set to 0 to prepare the algorithm for the next negative half period duration measurement.

Figure 12:
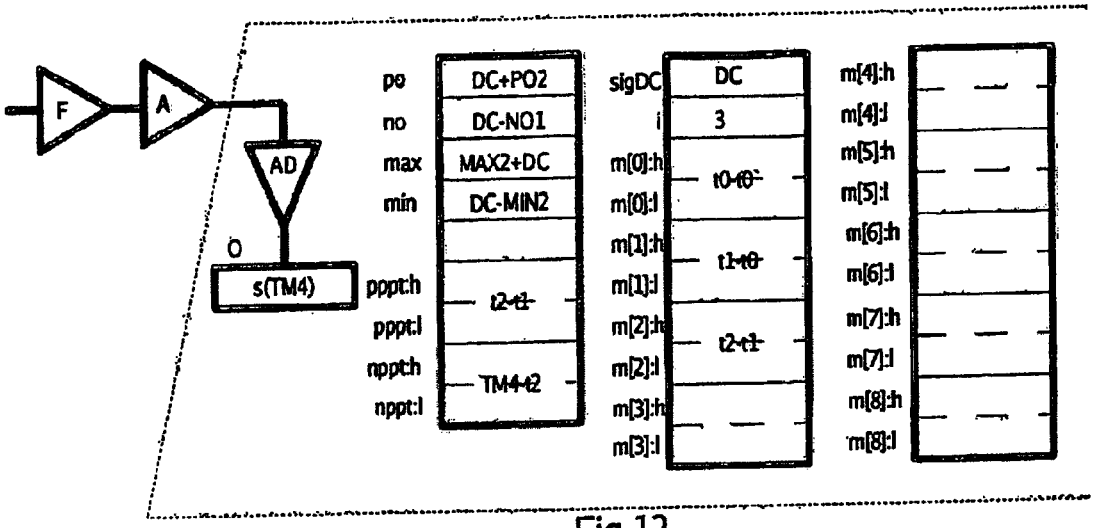
Figure 13:
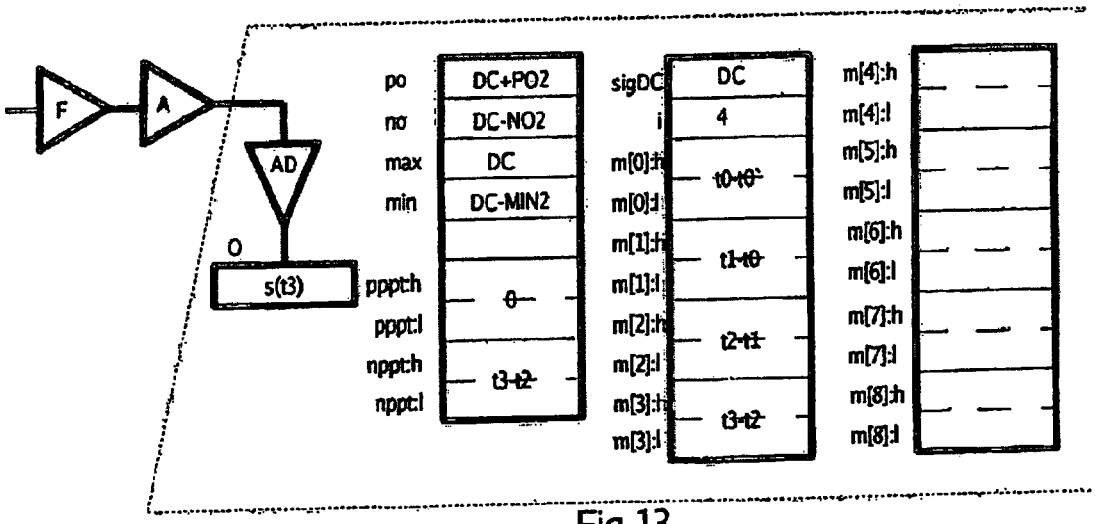

FIG. 11 shows the microcontroller registers when the negative trigger value no is passed in sample t2. At this time, the minimum calculation starts and the negative half period duration measuring starts. As will be described below, the minimum register "min" will be set to a new sample value if the new sample value is less than the last sample value in register "min". Referring to FIG. 1, from the sample t2 to sample TM4, the value stored in register "min" changes and the TM4 sample minimum signal is reached in second signal period. After the TM4 sample, the register "min" in microcontroller is not changed and contains the value corresponding to DC−MIN2 value, where the t coordinate is DC signal level. FIG. 12 shows the state of the registers at the TM4 sample time. In register "O", the sample TM4 is stored and in register "min", the value DC−MIN2 is stored, which corresponds to the TM4 sample value. After the TM4 sample, the microcontroller register "min" is not changed and contains value DC−MIN2 because all of the next signal samples to sample time t4 are greater than the value DC−MIN2. The next characteristic point in the algorithm is at sample time t3 when the input signal value becomes greater than the positive trigger po. At sample time t3, the input signal value sample is greater than the value in register "po". A new negative trigger value is calculated, and in register "no", the value DC−NO2 is stored. This new negative trigger value will be used at sample time t4. This new state in microcontroller register is shown in FIG. 13. The 16 bit register "nppt" has a value corresponding to t3−t2. As before, the t coordinate shows the number of samples, and accordingly, t3−t2 is number of samples between sample t2 and t3. Register "nppt" contains the negative half period duration in sample numbers. This negative half period duration is stored in the 16 bit registers m[3] and pointer I is incremented to point to the next free registers to store the next positive half period duration.

Figure 14:
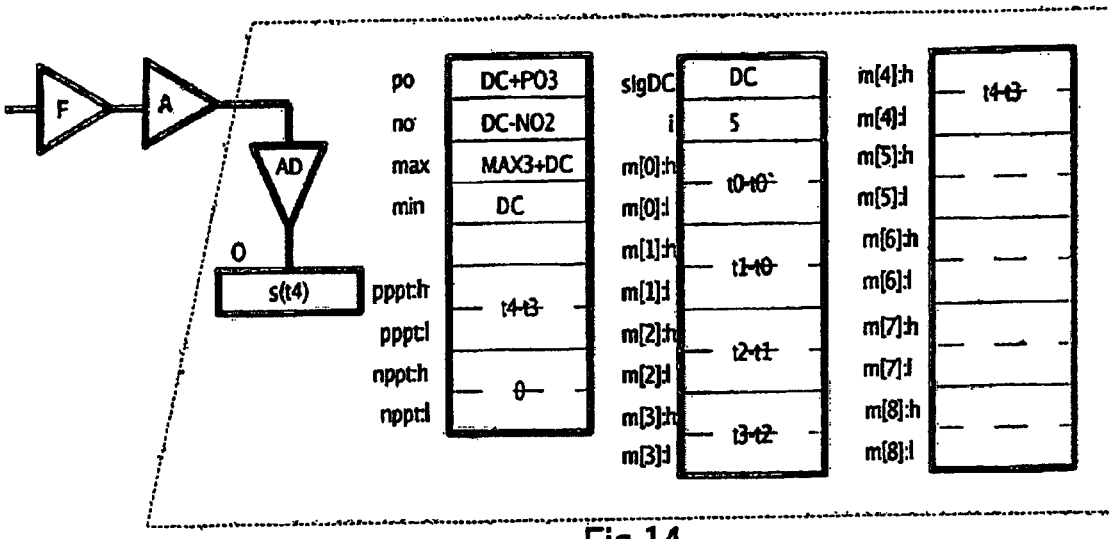
Figure 15:
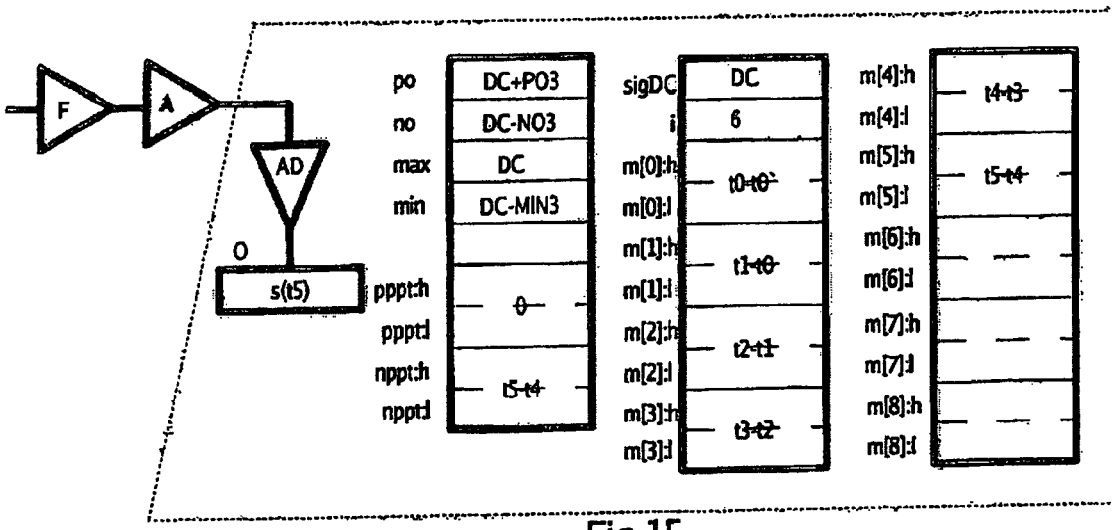

FIG. 14 shows microcontroller registers at the t4 sample time and FIG. 15 shows microcontroller registers at the t5 sample time.

As described above, the microcontroller registers m[ ] contains the measured half periods. After the first half period, the positive and negative trigger values are proportional to maximum and minimum in the first signal half period. At this point in the algorithm, two sums are calculated: sum S1=m[2]+m[3]=t3−t1 and sum S2=m[4]+m[3]=t4−t2. Sum S2 may also be calculated as S2=m[5]+m[4]=t5−t3. If the difference S2−S1 is small enough, then one of sums can be chosen as the signal period. This can be shown by the equation ((S1−S2)< (S1/64)).

This algorithm also detects signal loss when the positive or negative half period duration becomes greater than the constants maxpT or maxnT. When the algorithm is started, po=POM and no=NOM. After the sum S1 and sum S2 calculation, po=MPO and no=MNO. POM is greater than MPO and NOM is less than MNO. As described below, the algorithm determines when the input signal amplitude becomes low. When the input signal amplitude is under MPO or above MNO, signal loss will be detected, and po=POM and no=NOM. Signal amplitude will have to rise above POM and under NOM to start half period measuring again as described previously. Signal loss detection is used to generate commands corresponding to MIDI "note off," and signal detection and period detection is used to generate commands corresponding to MIDI "note on." When the input signal amplitude is not monotonously falling in time but increases and decrease in time, input signals will be detected when the positive amplitude is greater than POM, and signal loss will be detected when the positive amplitude is less than MPO. The difference between POM and MPO prevents the generation of false "note on" and "note off" commands, if the input signal amplitude variation is less than the difference of POM−MPO. Also, an input signal will be detected when the negative amplitude is under NOM, and signal loss will be detected when the negative amplitude is above MNO. The difference MNO−NOM will prevent the generation of false "note on" and "note off" commands, if the signal amplitude variation is less than the difference of MNO−NOM.

As shown above, MIDI control signals may be created, which be used for operation of an electronic instrument. Any sound source can be used to generate the MIDI control signals for an electronic music instrument. For instance, the methods described herein may be used to convert guitar string sounds to MIDI commands. The MIDI commands may be sent to an electronic device with a MIDI interface to produce sounds and different sound effects. The methods may also be employed for other string instruments, and for traditional instruments such as a trumpet, saxophone, etc.

FIG. 16 shows an overall view of an exemplary embodiment of the music processing system. A guitar MIDI controller device is indicated generally by reference character 20. The MIDI controller device 20 has a screen 22 and an actuator or user input apparatus 24. Screen 22 is preferably a Liquid-Crystal Display (LCD). The actuator or input apparatus 24 preferably comprises a joy-stick type control with 4 switches corresponding to up, down, left, and right. The actuator 24 may be used for modifying the MIDI command. For instance, the actuator may be configured as a "pitch bender." The actuator may also allow the user to navigate through menus to access different features on the controller such displaying pitches on the screen 22, or configuring the controller as an "auto tuner." A musical instrument 30, which can be a guitar or other stringed instrument, has a pick-up 32 that may be mounted in the sound hole of the guitar. The pick-up 32 is coupled to the controller device with a cable 34 extending from a plug receptacle 36 of the pick-up to an input 38 of the controller. The controller 20 may be coupled to a computer or other external processor 40 with a cable 42 extending from an output 44 of the controller to the computer. The controller and pick-up and external device may also be connected via a wireless network, Blue Tooth enabled, or connected via the cables shown.

The MIDI controller device may have a computer readable medium with executable instructions for calculating successive positive and negative half period duration measurements relating to the acoustic input signal using adaptive trigger levels to determine input signal loss and generate MIDI commands as will be described below. The controller device output 44 may be adapted to transmit generated MIDI commands from the controller to an external device 40. Software loaded on the external device may comprise computer readable instructions to process the MIDI commands from the controller 20 and enable the countless features as described herein. The computer or external processor 40 may comprise a computer with a display 50 where the display displays instructions for training a trainee in playing guitar. The display may display indicia 52 relating to the effectiveness of the trainee in training with the musical instrument. The display may display indicia in response to the trainee operating the musical instrument. The display may display indicia representative of the acoustic sounds developed by the trainee operating the musical instruments. These are just some of the features mentioned previously and enable the system to perform a multitude of tasks and enhance the user's or trainee's interactive experience.

Figure 17B:
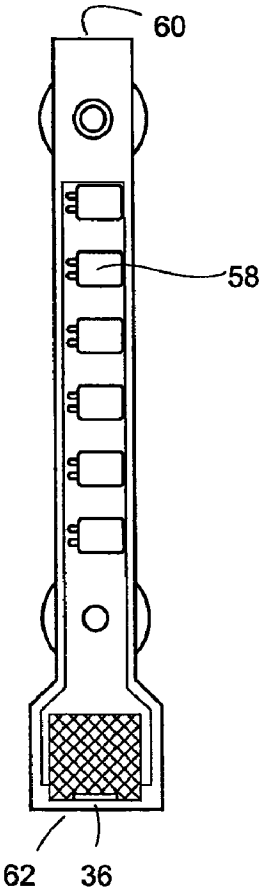
FIG. 17*a*-17*b* show various detailed views of a pick-up of FIG. 16.
Figure 17A:
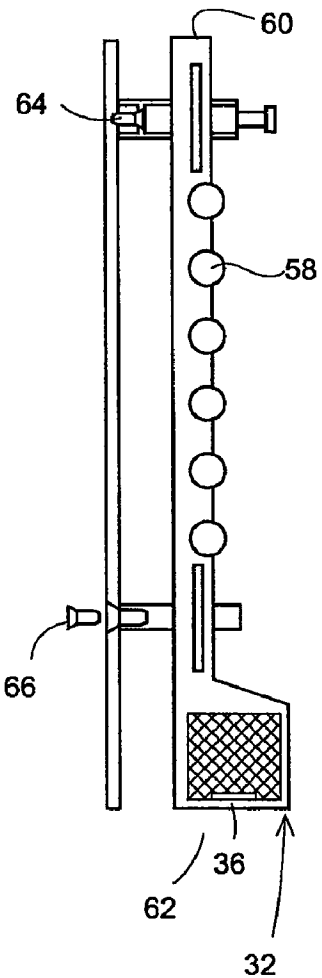

FIG. 17 shows a detailed view of pick-up 32 in an exemplary embodiment. The pick-up 32 preferably includes an inductive sensor 58 for each string of a guitar (which usually has 6 strings). The pick-up 32 is attached to the guitar 30 and lateral edges 60,62 of the pick-up are positionable relative to the strings of the guitar by jack screws 64,66. The pick-up may be hardwired or may have a connector receptacle 36 adapted to receive a conventional plug, or mini-plug as shown in FIG. 17.

Figure 18:
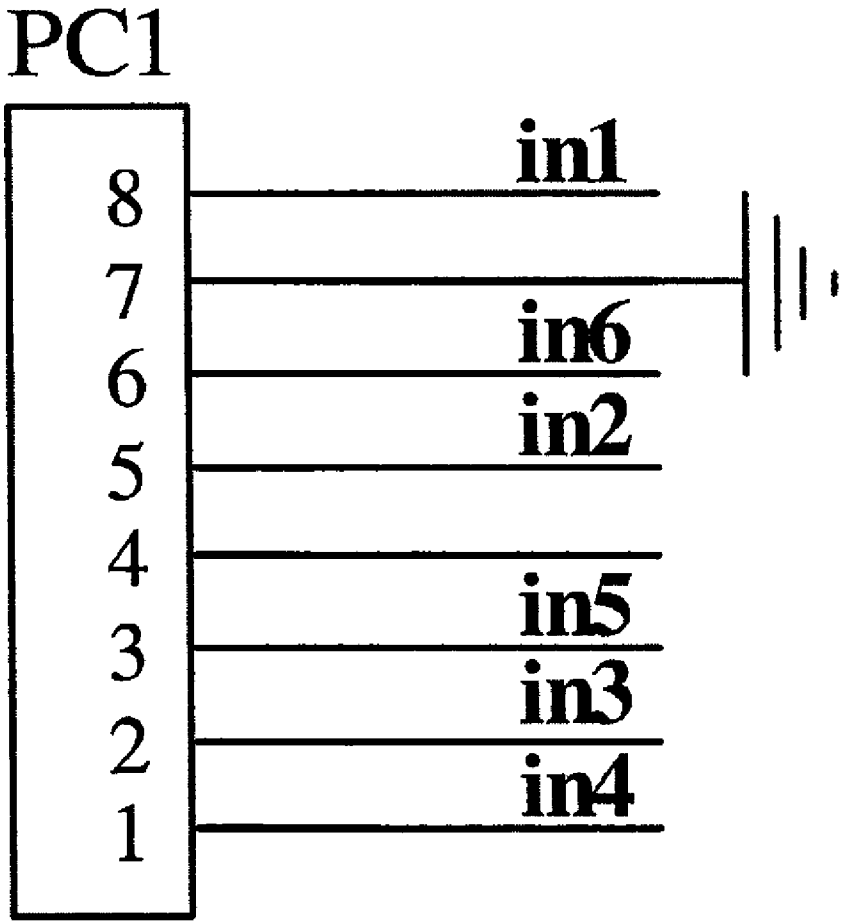
FIG. 18 shows an exemplary circuit schematic for the electrical output of the pick-up of FIG. 17.

FIG. 18 shows an exemplary circuit schematic for the electrical output of pick-up 10 in an exemplary embodiment. Connector PCl preferably has 8 pins. A pin carries signal in1 which corresponds to the output of an inductive sensor 58 on pick-up 32 dedicated to the "High E" string of guitar 30. Signal in1 is delivered to the circuit shown in FIG. 19. A pin carries signal in2 which corresponds to the output of an inductive sensor 58 on pick-up 32 dedicated to the "B" string of guitar 30. Signal in2 is delivered to the circuit shown in FIG. 20. A pin carries signal in3 which corresponds to the output of an inductive sensor 58 on pick-up 32 dedicated to the "G" string of guitar 30. Signal in3 is delivered to the circuit shown in FIG. 21. A pin carries signal in4 which corresponds to the output of an inductive sensor 58 on pick-up 32 dedicated to the "D" string of guitar 30. Signal in4 is delivered to the circuit shown in FIG. 22. A pin carries signal in5 which corresponds to the output of an inductive sensor 58 on pick-up 32 dedicated to the "A" string of guitar 30. Signal in5 is delivered to the circuit shown in FIG. 23. A pin carries signal in6 which corresponds to the output of an inductive sensor 58 on pick-up 32 dedicated to the "Low E" string of guitar 30. Signal in6 is delivered to the circuit shown in FIG. 24.

In the embodiments shown in FIGS. 19-24, one set of filters, amplifiers, and low-capacity microcontroller processes the input sound signal generated by each guitar string. The filters are low pass type and the upper 3-dB frequency depends on the frequency of the highest basic sound harmonic generated by the respective guitar string. The values of the components for each filter and amplifier shown in FIGS. 19-24 were chosen in accordance with the highest basic sound harmonic generated by the respective guitar string. Other combinations may also produce the desired filtering and amplification.

FIG. 19 shows an exemplary amplification and filtering circuit for processing a signal in1 from pick-up dedicated to the "High E" string in an exemplary embodiment. Signal in1 is preferably provided by the connector shown in FIG. 18. Resistor R11 is preferably a 2.2 k Ohm resistor. Capacitor C11 is preferably a 0.1 μF capacitor. Resistor R21 is preferably a 560 k Ohm resistor. Resistor R31 is preferably a 560 k Ohm resistor. Capacitor Cu1 is preferably a 0.1 μF capacitor. Amplifier U1A is preferably an amplifier contained within an LM324 Low Power Quad Operational Amplifiers chip, which is available from National Semiconductor as well as a variety of other manufacturers. Resistor R41 is preferably a 100 k Ohm resistor. Resistor R51 is preferably a 360 k Ohm resistor. Capacitor C31 is preferably a 220 pF capacitor. Capacitor C21 is preferably a 2.2 nF capacitor. Amplifier U1D is preferably an amplifier contained within an LM324 chip. Resistor R61 is preferably a 47 k Ohm resistor. Resistor R71 is preferably a 120 k Ohm resistor. Capacitor C51 is preferably a 1.5 nF capacitor. Capacitor C41 is preferably a 2.2 nF capacitor. Amplifier U1C is preferably an amplifier contained within an LM324 chip. Capacitor C61 is preferably a 3.3 μF electrolytic capacitor. Capacitor C71 is preferably a 3.3 μF electrolytic capacitor. Resistor R81 is preferably a 1 k Ohm resistor. Resistor R91 is preferably a 560 k Ohm resistor. Amplifier U1B is preferably an amplifier contained within an LM324 chip. Resistor R1 is preferably a 2.2 k Ohm resistor. The output of this circuit is designated as ina1, which is preferably delivered to a low-capacity microcontroller such as chip P(x) shown in FIG. 25.

FIG. 20 shows an exemplary amplification and filtering circuit for processing a signal in2 from pick-up dedicated to the "B" string in an exemplary embodiment. Signal in2 is preferably provided by the connector shown in FIG. 18. Resistor R12 is preferably a 2.2 k Ohm resistor. Capacitor C12 is preferably a 0.1 μF capacitor. Resistor R22 is preferably a 560 k Ohm resistor. Resistor R32 is preferably a 560 k Ohm resistor. Capacitor Cu2 is preferably a 0.1 μF capacitor. Amplifier U2A is preferably an amplifier contained within an LM324 Low Power Quad Operational Amplifiers chip, which is available from National Semiconductor as well as a variety of other manufacturers. Resistor R42 is preferably a 150 k Ohm resistor. Resistor R52 is preferably a 510 k Ohm resistor. Capacitor C32 is preferably a 220 pF capacitor. Capacitor C22 is preferably a 2.2 nF capacitor. Amplifier U2D is preferably an amplifier contained within an LM324 chip. Resistor R62 is preferably a 68 k Ohm resistor. Resistor R72 is preferably a 180 k Ohm resistor. Capacitor C52 is preferably a 1.5 nF capacitor. Capacitor C42 is preferably a 2.2 nF capacitor. Amplifier U2C is preferably an amplifier contained within an LM324 chip. Capacitor C62 is preferably a 3.3 μF electrolytic capacitor. Capacitor C72 is preferably a 3.3 μF electrolytic capacitor. Resistor R82 is preferably a 1 k Ohm resistor. Resistor R92 is preferably a 560 k Ohm resistor. Amplifier U2B is preferably an amplifier contained within an LM324 chip. Resistor R2 is preferably a 2.2 k Ohm resistor. The output of this circuit is designated as ina2, which is preferably delivered to a low-capacity microcontroller such as chip P(x) shown in FIG. 25.

FIG. 21 shows an exemplary amplification and filtering circuit for processing a signal in3 from pick-up dedicated to the "G" string in an exemplary embodiment. Signal in3 is preferably provided by the connector shown in FIG. 18. Resistor R13 is preferably a 2.2 k Ohm resistor. Capacitor C13 is preferably a 0.1 μF capacitor. Resistor R23 is preferably a 560 k Ohm resistor. Resistor R33 is preferably a 560 k Ohm resistor. Capacitor Cu3 is preferably a 0.1 μF capacitor. Amplifier U3A is preferably an amplifier contained within an LM324 Low Power Quad Operational Amplifiers chip, which is available from National Semiconductor as well as a variety of other manufacturers. Resistor R43 is preferably a 180 k Ohm resistor. Resistor R53 is preferably a 680 k Ohm resistor. Capacitor C33 is preferably a 220 pF capacitor. Capacitor C23 is preferably a 2.2 nF capacitor. Amplifier U3D is preferably an amplifier contained within an LM324 chip. Resistor R63 is preferably a 82 k Ohm resistor. Resistor R73 is preferably a 220 k Ohm resistor. Capacitor C53 is preferably a 1.5 nF capacitor. Capacitor C43 is preferably a 2.2 nF capacitor. Amplifier U3C is preferably an amplifier contained within an LM324 chip. Capacitor C63 is preferably a 3.3 μF electrolytic capacitor. Capacitor C73 is preferably a 3.3 μF electrolytic capacitor. Resistor R83 is preferably a 1 k Ohm resistor. Resistor R93 is preferably a 560 k Ohm resistor. Amplifier U3B is preferably an amplifier contained within an LM324 chip. Resistor R3 is preferably a 2.2 k Ohm resistor. The output of this circuit is designated as ina3, which is preferably delivered to a low-capacity microcontroller such as chip P(x) shown in FIG. 25.

FIG. 22 shows an exemplary amplification and filtering circuit for processing a signal in4 from pick-up dedicated to the "D" string in an exemplary embodiment. Signal in4 is preferably provided by the connector shown in FIG. 18. Resistor R14 is preferably a 2.2 k Ohm resistor. Capacitor C14 is preferably a 0.1 μF capacitor. Resistor R24 is preferably a 560 k Ohm resistor. Resistor R34 is preferably a 560 k Ohm resistor. Capacitor Cu4 is preferably a 0.1 μF capacitor. Amplifier U4A is preferably an amplifier contained within an LM324 Low Power Quad Operational Amplifiers chip, which is available from National Semiconductor as well as a variety of other manufacturers. Resistor R44 is preferably a 240 k Ohm resistor. Resistor R54 is preferably a 820 k Ohm resistor. Capacitor C34 is preferably a 220 μF capacitor. Capacitor C24 is preferably a 2.2 nF capacitor. Amplifier U4D is preferably an amplifier contained within an LM324 chip. Resistor R64 is preferably a 100 k Ohm resistor. Resistor R74 is preferably a 270 k Ohm resistor. Capacitor C54 is preferably a 1.5 nF capacitor. Capacitor C44 is preferably a 2.2 nF capacitor. Amplifier U4C is preferably an amplifier contained within an LM324 chip. Capacitor C64 is preferably a 3.3 μF electrolytic capacitor. Capacitor C74 is preferably a 3.3 μF electrolytic capacitor. Resistor R84 is preferably a 1 k Ohm resistor. Resistor R94 is preferably a 560 k Ohm resistor. Amplifier U4B is preferably an amplifier contained within an LM324 chip. Resistor R4 is preferably a 2.2 k Ohm resistor. The output of this circuit is designated as ina4, which is preferably delivered to a low-capacity microcontroller such as chip P(x) shown in FIG. 25.

FIG. 23 shows an exemplary amplification and filtering circuit for processing a signal in5 from pick-up dedicated to the "A" string in an exemplary embodiment. Signal in5 is preferably provided by the connector shown in FIG. 18. Resistor R15 is preferably a 2.2 k Ohm resistor. Capacitor C15 is preferably a 0.1 μF capacitor. Resistor R25 is preferably a 560 k Ohm resistor. Resistor R35 is preferably a 560 k Ohm resistor. Capacitor Cu5 is preferably a 0.1 μF capacitor. Amplifier U5A is preferably an amplifier contained within an LM324 Low Power Quad Operational Amplifiers chip, which is available from National Semiconductor as well as a variety of other manufacturers. Resistor R45 is preferably a 330 k Ohm resistor. Resistor R55 is preferably a 1.1M Ohm resistor. Capacitor C35 is preferably a 220 pF capacitor. Capacitor C25 is preferably a 2.2 nF capacitor. Amplifier U5D is preferably an amplifier contained within an LM324 chip. Resistor R65 is preferably a 130 k Ohm resistor. Resistor R75 is preferably a 360 k Ohm resistor. Capacitor C55 is preferably a 1.5 nF capacitor. Capacitor C45 is preferably a 2.2 nF capacitor. Amplifier U5C is preferably an amplifier contained within an LM324 chip. Capacitor C65 is preferably a 3.3 μF electrolytic capacitor. Capacitor C75 is preferably a 3.3 μF electrolytic capacitor. Resistor R85 is preferably a 1 k Ohm resistor. Resistor R95 is preferably a 560 k Ohm resistor. Amplifier U5B is preferably an amplifier contained within an LM324 chip. Resistor R5 is preferably a 2.2 k Ohm resistor. The output of this circuit is designated as ina5, which is preferably delivered to a low-capacity microcontroller such as chip P(x) shown in FIG. 25.

FIG. 24 shows an exemplary amplification and filtering circuit for processing a signal in6 from pick-up dedicated to the "Low E" string in an exemplary embodiment. Signal in6 is preferably provided by the connector shown in FIG. 18. Resistor R16 is preferably a 2.2 k Ohm resistor. Capacitor C16 is preferably a 0.1 μF capacitor. Resistor R26 is preferably a 560 k Ohm resistor. Resistor R36 is preferably a 560 k Ohm resistor. Capacitor Cu6 is preferably a 0.1 μF capacitor. Amplifier U6A is preferably an amplifier contained within an LM324 Low Power Quad Operational Amplifiers chip, which is available from National Semiconductor as well as a variety of other manufacturers. Resistor R46 is preferably a 360 k Ohm resistor. Resistor R56 is preferably a 1.2M Ohm resistor. Capacitor C36 is preferably a 220 pF capacitor. Capacitor C26 is preferably a 2.2 nF capacitor. Amplifier U6D is preferably an amplifier contained within an LM324 chip. Resistor R66 is preferably a 16 k Ohm resistor. Resistor R76 is preferably a 430 k Ohm resistor. Capacitor C56 is preferably a 1.5 nF capacitor. Capacitor C46 is preferably a 2.2 nF capacitor. Amplifier U6C is preferably an amplifier contained within an LM324 chip. Capacitor C66 is preferably a 3.3 μF electrolytic capacitor. Capacitor C76 is preferably a 3.3 μF electrolytic capacitor. Resistor R86 is preferably a 1 k Ohm resistor. Resistor R96 is preferably a 560 k Ohm resistor. Amplifier U6B is preferably an amplifier contained within an LM324 chip. Resistor R6 is preferably a 2.2 k Ohm resistor. The output of this circuit is designated as ina6, which is preferably delivered to a low-capacity microcontroller such as chip P(x) shown in FIG. 25.

FIG. 25 shows an exemplary low capacity microcontroller dedicated to processing a signal from one of the circuits shown in FIGS. 16-21. FIG. 25 is representative of 6 such circuits—one associated with each filtering and amplification circuit for each guitar string input. Low-capacity microcontroller P(x) is representative of 6 low-capacity microcontrollers where x=1, 2, 3, 4, 5, and 6. Preferably, low-capacity microcontroller P(x) is a PIC12F683. Low-capacity microcontroller P(x) is preferably programmed to perform the adaptive triggering method disclosed above and as shown graphically in FIGS. 1-15. The PIC12F683 is available from a variety of manufacturers, including Microchip Technology of Chandler, Ariz. As shown in FIG. 22, ina(x) is an input into the PIC12F683. Input ina(x) is received from one of the circuits shown in FIGS. 16-21, where x=1 for the circuit of FIG. 19, x=2 for the circuit of FIG. 20, x=3 for the circuit of FIG. 21, x=4 for the circuit of FIG. 22, x=5 for the circuit of FIG. 23, and x=6 for the circuit of FIG. 24. Microcontroller P(x) performs signal analysis on the signal received on line ina(x), and generates MIDI commands based on this analysis. Input CLK is a clock signal provided by the circuit of FIG. 28. Input pitchmode is a binary signal provided by the main microcontroller MP as shown in FIG. 27 that changes the generated MIDI output messages depending upon its state (high or low). Input p(x)ti is a binary signal provided by the main microcontroller MP as shown in FIG. 27. As discussed above, when p(x)ti is equal to "1" (a "high" voltage) it indicates that main microcontroller MP is ready to receive data from low capacity microcontroller P(x). Low-capacity microcontroller P(x) is programmed to output a "high" value for output p(x)hi when low-capacity microcontroller P(x) has data ready to send. Low-capacity microcontroller P(x) is programmed to output data on line p(x)data. Output p(x)data is preferably delivered to the circuit shown in FIG. 26. Capacitor CP1 is preferably a 100 nF capacitor.

FIG. 26 shows an exemplary embodiment of a digital circuit for transmitting the data from the 6 low capacity microcontrollers p(1)-p(6) (represented by p(x) in FIG. 25) to the main microcontroller MP. The purpose of this circuit is to "collect" the signals from the 6 low capacity microcontrollers as inputs p(1)data-p(6)data (represented by p(x)data in FIG. 25), and output a single data signal MIDIn. Components S1A, S1B, and S1C are all preferably AND gates provided on chip CD4073B, which is available from Texas Instruments as well as a variety of other manufacturers. Capacitor CPAND is preferably a 100 nF capacitor. The output of this circuit, designated MIDIn, is provided as an input to the main microcontroller MP as shown in FIG. 27.

FIG. 27 shows an exemplary main microcontroller MP and associated wiring in an exemplary embodiment. Main microcontroller MP receives input data signal MIDIin from the circuit shown in FIG. 26. Push-buttons SU, SD, SL, and SR provide user input to the device, for instance from actuator (reference character 24, FIG. 16), and correspond to Up, Down, Left, and Right, respectively. Main microcontroller MP can optionally be programmed to modify the input MIDI commands based on received user input. Liquid Crystal Display LCD (reference character 22, FIG. 16) provides visual information to the user. Main microcontroller collects MIDI commands from all six small capacity microcontrollers at pin 29 (MIDIin). The main microcontroller coordinates the transmission of data from the low-capacity microcontrollers. As described above, the low-capacity microcontrollers will not transmit data until they receive an allow signal p(x)ti from the main microcontroller. In other words, the main microcontroller has timing such that the low capacity microcontrollers cannot send MIDI commands to microcontroller simultaneously, that is, two microcontrollers cannot concurrently send MIDI commands to the main microcontroller. Optionally, the main microcontroller periodically polls the p(x)hi signal provided by each of the low capacity microcontrollers for the presence of a "MIDI ready" signal at pin 5 (referred to as p(x)hi where x is 1, 2, 3, 4, 5, or 6), and if the p(x)hi signal is present, the main microcontroller, when it is ready, can signal the low-capacity microcontroller to send data via the "ready to transmit" signal at pin 4 (referred to as p(x)ti (where x is 1, 2, 3, 4, 5, or 6)). In an alternative embodiment, the main microcontroller may support "interrupt" based I/O which eliminates the need for polling. The low-capacity microcontrollers transmit MIDI commands from pin 6 (referred to as p(x)data (where x is 1, 2, 3, 4, 5, or 6) to the pin 29 (MIDIin) of the main microcontroller. As shown in FIG. 26, the pin 29 (MIDIin) on the main microcontroller is connected to the output of an digital logic circuit (as shown in FIG. 26) which collects data signals from all low capacity microcontroller pin 6 (p(x)data (where x is 1, 2, 3, 4, 5, or 6)). The main microcontroller selects which low capacity microcontroller will transmit the MIDI command to main microcontroller as described above. The main microcontroller can modify the received MIDI commands from the low capacity microcontrollers and then send the commands to the MIDI interface via pin 27 (MIDIout). For example, the main microcontroller can send a MIDI command from each low-capacity microcontroller on a separate MIDI channel or it can send the collected MIDI commands on a single MIDI channel.

FIG. 28 shows an exemplary circuit for generating a clock signal CLK. Clock signal CLK is preferably provided to all of the microcontrollers, specifically P(X) and MP as shown in FIGS. 25 and 27 respectively. Connector JMIDI provides an output jack that carries the generated MIDI commands to an external device.

FIG. 29 shows an exemplary circuit for providing MIDI command output on a USB connector J1USB in an exemplary embodiment. It should be noted that providing a USB connector is optional. Chip Us is preferably a CH345T. Signal MIDIOUT is provided by the main microcontroller as shown in FIG. 27. Chip Us is used to provide a USB interface to the MIDI guitar. Resister Ru1 is preferably a 10 Ohm resistor, Resistor Ru2 is preferably a 10 Ohm resistor. Resistor Ru3 is preferably a 2.2 Ohm resistor. Capacitor Co1 is preferably a 22 pF capacitor. Capacitor Co2 is preferably a 22 pF capacitor. Crystal oscillator X1 is preferably a 12 MHz crystal oscillator. Capacitor Co3 is preferably a 10 uF electrolytic capacitor. Capacitor Co4 is preferably a 100 nF capacitor. Capacitor Co5 is preferably a 1 nF capacitor.

As described above, the MIDI command may be generated when the microcontroller detects the sound signal, or when the input signal is lost during monitoring of the sound signal. Referring to an embodiment shown in the schematic drawings of FIGS. 25 and 27, when the low-capacity microcontroller has generated a MIDI command that is ready to be transmitted, the low-capacity microcontroller transmits a "MIDI ready" signal from pin 5 (referred to as p(x)hi (where x=1 to 6)) to the associated pin of the main microcontroller (pins 22, 24, 31, 33, 38, 42). The low-capacity microcontroller does not transmit the MIDI command data until the main microcontroller signals that it is ready to receive the data. When main microcontroller is ready to receive data from low-capacity microcontroller p(x), the main microcontroller transmits the "ready to transmit" signal from the associated pin (pins 21, 23, 30, 32, 37, 41) (referred to as p(x)ti (where x is 1, 2, 3, 4, 5, or 6)) to pin 4 of the small capacity microcontroller. When the small capacity microcontroller receives the "ready to transmit" signal at pin 4 (referred to as p(x)ti (where x is 1, 2, 3, 4, 5, or 6)), the small microcontroller transmits the MIDI command from pin 6 (referred to as p(x)data (where x is 1, 2, 3, 4, 5, or 6)) to the pin 29 (MIDIin) of the main microcontroller.

FIG. 30 shows an exemplary power supply circuit in an exemplary embodiment powering the circuits of FIGS. 19-29.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments.

What is claimed is:

1. A device for converting guitar sounds to MIDI commands comprising: a low capacity microcontroller associated with each guitar string, the low capacity microcontroller being configured to convert filtered and amplified signals oscillations from a guitar string to a corresponding MIDI command; and a main microcontroller operatively connected to the low capacity microcontroller, the main microcontroller being configured to receive and collect MIDI commands generated by the low capacity micro controllers, modify the MIDI commands, and transmit the modified MIDI command to the MIDI interface of a musical instrument.

2. The device of claim 1 wherein: each low capacity microcontroller comprises: (i) an input adapted to receive the amplified and filtered signals from the guitar string, (ii) an output adapted to transmit a MIDI command corresponding to the amplified and filtered signal from the low capacity microcontroller to the main microcontroller, an (iii) output adapted to transmit a signal to the main microcontroller that the low capacity microcontroller has a MIDI command to be transmitted to the main micro controller, and (iv) an input adapted to receive a signal from the main microcontroller to transmit a MIDI command.

3. The device of claim 1 wherein: the main microcontroller comprises: (i) an input adapted to receive a signal from the low capacity microcontroller that the low capacity microcontroller has a MIDI command to be transmitted to the main microcontroller; (ii) an output adapted to transmit a signal from the main microcontroller to each low capacity microcontroller to transmit a MIDI command from the low capacity microcontroller to the main microcontroller; and (iii) one input for receiving MIDI commands sent by each low capacity microcontroller.

* * * * *